US010632640B2

(12) United States Patent
Bucks

(10) Patent No.: US 10,632,640 B2
(45) Date of Patent: Apr. 28, 2020

(54) KNIFE ASSEMBLY FOR CORRUGATED KNIFE BLADE AND CUTTING SYSTEM EQUIPPED WITH SAME

(71) Applicant: FAM, Kontich (BE)

(72) Inventor: Brent Bucks, Lakewood Ranch, FL (US)

(73) Assignee: FAM, Kontich (BE)

( * ) Notice: Subject to any disclaimer, the term of this patent is extended or adjusted under 35 U.S.C. 154(b) by 0 days.

(21) Appl. No.: 15/037,043

(22) PCT Filed: Nov. 21, 2014

(86) PCT No.: PCT/EP2014/075275

§ 371 (c)(1),
(2) Date: May 16, 2016

(87) PCT Pub. No.: WO2015/075180

PCT Pub. Date: May 28, 2015

(65) Prior Publication Data

US 2016/0288358 A1 Oct. 6, 2016

Related U.S. Application Data

(60) Provisional application No. 61/907,073, filed on Nov. 21, 2013.

(30) Foreign Application Priority Data

Feb. 3, 2014 (EP) ..... 14153723

(51) Int. Cl.
*B26D 7/26* (2006.01)
*B26D 1/36* (2006.01)
(Continued)

(52) U.S. Cl.
CPC ..... *B26D 7/2614* (2013.01); *B26D 1/03* (2013.01); *B26D 1/36* (2013.01); *B26D 1/40* (2013.01);
(Continued)

(58) Field of Classification Search
CPC ..... B26D 7/0691; B26D 7/2614; B26D 7/06; B26D 7/26; B26D 2007/2607
(Continued)

(56) References Cited

U.S. PATENT DOCUMENTS 2,922,590 A * 1/1960 Percy ..... B27L 11/005 241/92
3,490,504 A * 1/1970 Reynolds ..... B26D 7/06 83/435
(Continued)

FOREIGN PATENT DOCUMENTS

EP 1543927 A2 6/2005
GB 461012 A 2/1937
(Continued)

OTHER PUBLICATIONS

Written Opinion and International Search Report of International Application No. PCT/EP2014/075275 filed Nov. 21, 2014.

*Primary Examiner* — Jason Daniel Prone
*Assistant Examiner* — Richard D Crosby, Jr
(74) *Attorney, Agent, or Firm* — N.V. Nederlandsch Octrooibureau; Catherine A. Shultz; Katelyn J. Bernier

(57) ABSTRACT

A knife assembly including a corrugated knife blade, a holder, a clamp arranged for clamping the knife blade onto the holder, and a fastening mechanism for securing the knife blade between the clamp and the holder. The clamp has clamping parts along a clamping line rearward from the front edge. The clamp includes clamping geometrical elements, corresponding to complementary contact geometrical
(Continued)

elements of the knife blade, positioned at least in part at a different distance from said front edge than the clamping line. The clamp engages the knife blade along the clamping line and at the corresponding contact geometrical elements.

19 Claims, 29 Drawing Sheets

(51) Int. Cl.
*B26D 1/40* (2006.01)
*B26D 3/28* (2006.01)
*B26D 1/62* (2006.01)
*B26D 7/06* (2006.01)
*B26D 1/03* (2006.01)

(52) U.S. Cl.
CPC ..... *B26D 1/62* (2013.01); *B26D 3/28* (2013.01); *B26D 7/0691* (2013.01); *B26D 2210/02* (2013.01)

(58) Field of Classification Search
USPC ..... 83/402–408
See application file for complete search history.

(56) References Cited

U.S. PATENT DOCUMENTS 3,857,310 A * 12/1974 Tiby ..... B26D 1/25 209/638
3,888,426 A * 6/1975 Urschel ..... B02C 18/062 241/221
4,206,671 A * 6/1980 Hoehn ..... B26D 1/02 198/676
4,298,044 A * 11/1981 Hansel ..... B27L 11/005 144/176
4,372,184 A * 2/1983 Fisher ..... B26D 3/185 83/102
4,391,172 A * 7/1983 Galland ..... B26D 1/02 83/403
4,523,503 A * 6/1985 Julian ..... B26D 1/03 83/403
4,590,835 A * 5/1986 Matsuo ..... B26D 1/03 83/403
4,601,227 A * 7/1986 Fitzwater ..... B26D 3/22 426/144
4,648,296 A * 3/1987 Wisdom ..... B26D 1/03 83/13
4,700,600 A * 10/1987 Pickett ..... G01N 1/06 83/165
4,739,939 A * 4/1988 Panning ..... B02C 18/145 241/294
4,794,961 A 1/1989 Bonac
4,813,317 A * 3/1989 Urschel ..... B26D 1/36 83/356.3
4,852,441 A * 8/1989 Anders ..... B26D 1/29 83/155
4,945,794 A * 8/1990 Quo ..... B26D 1/03 83/13
4,972,888 A * 11/1990 Dean ..... B27L 11/005 144/172
5,088,372 A * 2/1992 Lund ..... B26D 1/0006 83/402
5,095,875 A * 3/1992 Morris ..... B26D 1/0006 83/403
5,191,819 A * 3/1993 Hoshi ..... B26D 1/035 83/349
5,211,097 A 5/1993 Grasselli
5,271,442 A * 12/1993 Carpenter ..... B27L 11/005 144/162.1
5,469,902 A * 11/1995 Sharp ..... B27G 13/10 144/176
5,485,873 A * 1/1996 Crammond ..... B27L 11/005 144/162.1
5,555,787 A * 9/1996 Barber ..... B23D 35/008 83/403
5,694,824 A * 12/1997 Jacko ..... B26D 1/03 83/403
5,819,628 A * 10/1998 Cogan ..... B23D 35/008 83/698.11
5,937,923 A * 8/1999 Bielagus ..... B27L 11/02 144/163
5,979,522 A * 11/1999 Swartwood ..... B02C 18/143 144/162.1
5,992,284 A * 11/1999 Bucks ..... B26D 1/0006 83/663
6,148,702 A * 11/2000 Bucks ..... B26D 1/0006 83/110
6,561,885 B1 * 5/2003 Loth ..... B27L 11/005 241/191
6,662,837 B2 * 12/2003 Smith ..... B27G 13/04 144/162.1
6,883,411 B2 * 4/2005 Arrasmith ..... B26D 1/02 416/187
6,895,846 B2 * 5/2005 Walker ..... B26D 1/02 83/403
6,968,765 B2 * 11/2005 King ..... B26D 7/0691 83/403
7,178,440 B2 * 2/2007 Bucks ..... B26D 1/29 83/591
7,584,772 B2 * 9/2009 Jonkka ..... B27G 13/10 144/162.1
7,721,637 B2 * 5/2010 Bucks ..... B26D 1/0006 83/349
7,854,949 B2 * 12/2010 Haas ..... A21D 13/80 426/104
8,109,188 B2 * 2/2012 Bellmunt-Molins ..... B26D 1/0006 426/144
8,161,856 B2 * 4/2012 Jacko ..... B26D 1/03 83/403
8,205,650 B2 * 6/2012 Zinniger ..... B27G 13/04 144/172
D722,822 S * 2/2015 Huber ..... D7/412
9,193,086 B2 * 11/2015 Jacko ..... B26D 7/2614
D745,338 S * 12/2015 Bucks ..... D7/650
D750,342 S * 3/2016 Vitaloni ..... D1/128
D751,791 S * 3/2016 Vitaloni ..... D1/128
9,440,369 B2 * 9/2016 Bayer ..... B26D 7/025
9,462,818 B2 * 10/2016 Barber ..... A23P 30/10
9,469,041 B2 * 10/2016 King ..... B26D 1/03
9,517,572 B2 * 12/2016 Michel ..... B26D 7/0691
9,592,618 B2 * 3/2017 Reis ..... B26D 3/10
D793,158 S * 8/2017 Bucks ..... D7/401.2
9,718,203 B2 * 8/2017 Bucks ..... B26D 7/2614
9,914,232 B2 * 3/2018 Walker ..... B26D 1/28
2013/0276604 A1 * 10/2013 King ..... B26D 1/03 83/52
2014/0290451 A1 * 10/2014 Jacko ..... B26D 7/2614 83/13
2016/0067877 A1 * 3/2016 Cogan ..... B26D 7/2614 83/13
2016/0361831 A1 * 12/2016 Fant ..... B26D 1/03
2017/0072579 A1 * 3/2017 Reis ..... B26D 3/10
2017/0106550 A1 * 4/2017 Jacko ..... B26D 3/26

FOREIGN PATENT DOCUMENTS

GB 2182881 A 5/1987
JP 2003285295 10/2003
JP 5135327 2/2013
WO WO2013/101621 A1 7/2013

* cited by examiner

KNIFE ASSEMBLY FOR CORRUGATED KNIFE BLADE AND CUTTING SYSTEM EQUIPPED WITH SAME

TECHNICAL FIELD

The invention relates to a knife assembly for a cutting apparatus and further to a cutting apparatus or a part thereof such as a cutting head or system equipped with such a knife assembly for cutting food products and use thereof.

BACKGROUND ART

A cutting apparatus employing a plurality of knife assemblies is for example known from WO patent No. 2013/101621. A knife assembly for use in such apparatus is shown in FIG. 1 herein. Another known knife assembly is shown in FIG. 25 herein.

These knife assemblies comprise a knife blade having a predetermined shape for cutting food products. The knife blade can be positioned on a knife holder and secured onto the desired position by a knife clamp using a fastening mechanism. The knife assembly may be further fitted to a mechanically driven cutting apparatus to automate and speed up the process of cutting food products to the desired shape and size.

It has been found that the yield and appearance of the sliced food products produced by means of the known knife assemblies can be significantly affected by the movement of the knife blade during the cutting of food products. Therefore, it is of critical importance during cutting of food products that the movement of the knife blade is reduced to a minimum or eliminated.

DISCLOSURE OF THE INVENTION

It is an aim of this invention to provide an improved knife assembly for a knife blade such that the movement of the knife blade during cutting of a food product can be significantly reduced or eliminated.

It is a further aim of this invention to provide an improved knife assembly for a knife blade such that during cutting of a food product the amount of food product caught in between any space between the knife blade, clamp and holder can be significantly reduced or eliminated.

According to an aspect of this disclosure a knife assembly is provided comprising a knife blade of which a front edge is a cutting edge, a holder configured for supporting the knife blade, a clamp arranged for clamping the knife blade onto the holder; and a fastening mechanism cooperating with the holder and clamp for securing the knife blade between the clamp and the holder with the cutting edge protruding at the front side whereby the clamp has a clamping line rearward from the front edge corresponding to a complementary contact line at the knife blade characterized in that the clamp comprises one or more clamping geometrical elements corresponding to complementary contact geometrical elements of the knife blade, the clamping geometrical elements being positioned at least in part at a different distance from said front edge than said clamping line, such that in clamped state the clamp engages the corresponding contact geometrical elements of the knife blade.

As used herein, with knife blade is meant a knife typically constructed from a blank of sheet metal and of which at least a portion is sharpened. The knife blade can be straight or bent, typically by means of a forming process after sharpening the knife blade.

As used herein, with unclamped state is meant a state in which the knife blade is positioned on the holder and the clamp is positioned on the knife blade, without the fastening means being fastened or tightened to clamp the knife blade. With clamped state is meant a state in which the fastening means are then completely fastened or tightened.

In an embodiment thereof the knife assembly has one or more clamping geometrical elements extending over a certain length.

In an embodiment thereof the knife assembly has one or more clamping geometrical elements which are points or point like.

In accordance with this disclosure a knife assembly may further be provided wherein said clamping line corresponding to a complementary contact line at the knife blade defining a first clamping line and wherein said one clamping geometrical element being a second clamping line.

In an embodiment thereof said first and second lines may be at least in part parallel with each other.

In an even further embodiment thereof said first and second lines may be at least in part piece wise straight lines.

In accordance with this disclosure a knife assembly may be provided wherein said clamping line corresponding to a complementary contact line at the knife blade defining a first clamping line and wherein said one clamping geometrical element being a clamping surface of which said first clamping line is a part.

In accordance with this disclosure a knife assembly may be provided wherein the clamp comprises a first part defining the clamping line and a second part defining one or more geometrical elements.

In accordance with this disclosure a knife assembly may be provided wherein the engagement of the clamping line to its complementary contact line and the one or more clamping geometrical elements with its corresponding contact geometrical elements is established by use of selected shapes for the related parts of the knife, the clamp and the holder.

In accordance with this disclosure a knife assembly may be provided wherein said geometrical elements are arranged such that in clamped state an equal amount of clamping force across the corresponding contact geometrical elements of the knife blade is exerted.

In an embodiment of this disclosure the knife blade is a corrugated knife blade over a corrugated part having a continuous shape defining a periodic pattern of peaks and valleys over a certain distance.

In a further embodiment thereof the clamp has an inwardly corrugated shape complementary to that of the knife blade, preferably the clamp comprises a plurality of fingers, tips of which together form said first part (on the first clamping line) while its rearward parts together form said second part; the fingers and tips define said corrugated shape.

In an embodiment thereof at least a portion of one of said clamping geometrical elements is a flat surface.

In an even further embodiment said flat surfaces are defined by inwardly beveled parts of said clamp, preferably of said rearward parts of said fingers.

In an embodiment of this disclosure other inwardly beveled parts of said clamp may be provided also.

In accordance with this disclosure the portion of said clamp related to the geometrical elements and the corresponding portion of the holder may be complementary shaped (e.g. convexly and concavely curved; or the clamp having two or three contact lines with the holder being concave; etc.) for tensioning the knife blade.

In accordance with this disclosure the clamp may be shaped such that in clamped state the clamp tightly fits over the knife blade over its entire width, the fit being such that particles of product being cut are prevented from entering in between the clamp and the knife blade. In the embodiments where the clamp comprises fingers, this may be achieved by shaping these fingers such that in clamped state the fingers touch the knife blade at their tips and along their sides, such that any cavity between the clamp and the knife blade is substantially sealed off at the top side by these fingers, i.e. the fit is such that particles of product being cut are prevented from entering the cavity.

In an embodiment of this disclosure the clamp comprises stop parts arranged to engage rear edges of the knife blade, such that in the clamped state the stop parts limit the range of movement of the knife blade on the knife holder.

In an embodiment of this disclosure the fastening mechanism comprises a plurality of fixing elements cooperating with a plurality of bores provided on the holder and/or clamp.

In accordance with this disclosure the holder may comprise a back surface having a continuous corrugated shape over a certain distance corresponding to the corrugated shape of the knife blade.

In embodiments of this disclosure the corrugated shapes of the knife blade, the complementary part(s) of the clamp and/or the holder, and also that of the back surface of the holder and/or the "shoe" or cutting station to which the knife assembly may be mounted, may comprise of any one of following shapes, V-shaped, wavy, sinusoidal, trapezoid, or any combination thereof, or any other corrugated shape known to the person skilled in the art.

Another aspect of this disclosure, which may be combined with the other embodiments described herein, provides a cutting system, with at least one knife assembly positioned along the circumference of the cutting system.

In an embodiment thereof; this cutting system, also denoted a drum, has one knife assembly and is stationary, food product being fed to the drum and rotated therein by means of for example an impeller, so that the food product is pushed against the circumference of the drum by centrifugal force and cut by the knife assembly. Further cutting tools may be positioned downstream from the knife assembly to further reduce the food product.

In another embodiment of this disclosure, which may be combined with the other embodiments described herein, provides such cutting system, further denoted a cutting head, with at least two knife assemblies, for example (but not exclusively) according to embodiments as discussed above, positioned along the circumference of the cutting head for cutting products fed into the cutting head and pushed against its circumference by centrifugal force. Such cutting head may be used in an apparatus for cutting products, comprising: a base; the cutting head as described above with knife assemblies positioned along the circumference of the cutting head for cutting products fed into the cutting head, the cutting head being either stationary or rotatably fitted to the base; an impeller adapted for rotating concentrically within the cutting head to urge products fed into the cutting head towards the circumference of the cutting head by means of centrifugal force; a drive mechanism for driving at least the impeller at a first rotational speed and possibly also the cutting head at a second rotational speed; the difference between the first and second rotational speeds setting the cutting velocity.

This cutting head configuration may enable the production of a food product having a different shape impression on each of its sides.

BRIEF DESCRIPTION OF THE DRAWINGS

This disclosure will be further elucidated by means of the following description and the appended drawings.

MODES FOR CARRYING OUT THE INVENTION

Figure 1:
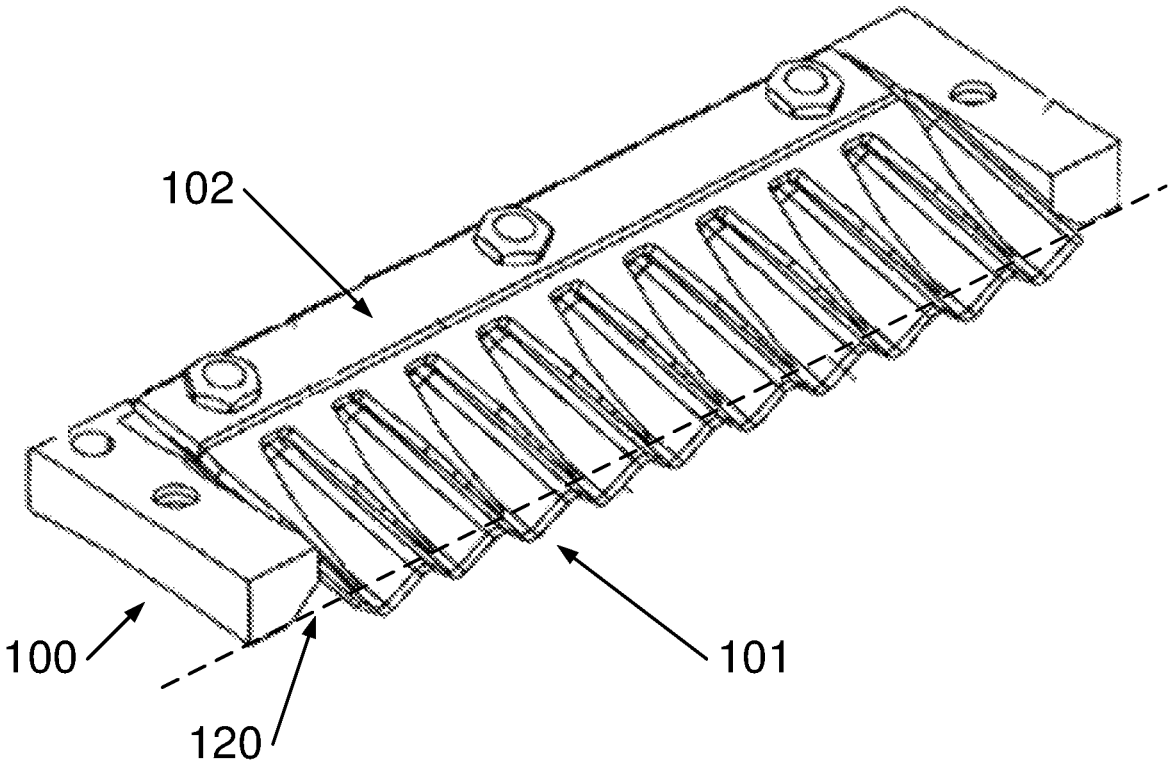
Fig. 1 (prior art)
FIG. 1 shows a prior art knife assembly.

The invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein.

Furthermore, the various embodiments, although referred to as "preferred" are to be construed as exemplary manners in which the invention may be implemented rather than as limiting the scope of the invention.

The term "comprising", used in the claims, should not be interpreted as being restricted to the elements or steps listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising A and B" should not be limited to devices consisting only of components A and B, rather with respect to the invention, the only enumerated components of the device are A and B, and further the claim should be interpreted as including equivalents of those components.

Figure 24:
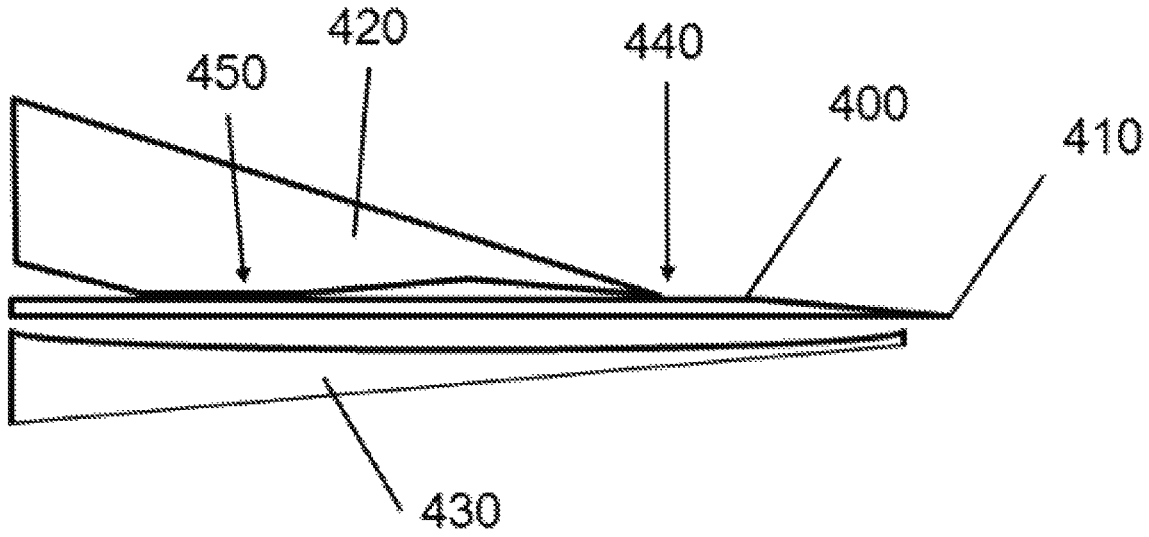
FIG. 24 shows an entirely schematic description of this disclosure.

Throughout the entire description with clamp is meant any of various devices used to join, grip, support, or compress mechanical or structural parts, such as in this disclosure the knife blade on the holder. With holder is meant any device for holding or supporting mechanical or structural parts, such as in this disclosure the knife blade on the holder. With clamping geometrical element is meant any point, line, area, or in general surface part or portion of the clamp that is arranged to engage corresponding contact geometrical elements of the knife blade. FIG. 24 shows an entirely schematic description of this disclosure with hypothetical dimensions and shapes only with a knife blade 400 of which a front edge 410 is a cutting edge, a holder 430, which as shown may be slightly concave, configured for supporting the knife blade 400, a clamp 420 arranged for clamping the knife blade 400 onto the holder whereby the clamp has a clamping line 440 in the direction orthogonal of the figure (hence here represented by a point) rearward from the front edge corresponding to a complementary contact line at the knife blade. The clamp comprises clamp parts (e.g. the tips of fingers described herein) for contacting and clamping the knife blade 400 at this clamping line 440. The clamp comprises at least one clamping geometrical element 450 corresponding to complementary contact geometrical element 450 of the knife blade, the clamping geometrical element 450 being positioned at least in part at a different distance from said front edge 410 than said clamping line 440, preferably further rearward from said front edge than said clamping line. The clamping parts and clamping geometrical elements 450 are arranged such that in clamped state the clamp 420 engages the knife blade 400 at the clamping line 440 and also at the corresponding contact geometrical elements 450 of the knife blade 400.

In the following, embodiments are described of knife assemblies for flat knife blades and knife assemblies for corrugated knife assemblies. The knife assemblies for flat knives are as such outside the scope of the claims, but are included as comparative examples. Furthermore, it is remarked that many features of the knife assemblies for flat knives may also be present in the knife assemblies for corrugated knives and vice versa, such as for example (not limited to): the beveled part(s) and their length; the fastening mechanism, comprising a plurality of fixing elements cooperating with a plurality of bores; the stop parts and stopping elements arranged for engaging the rear edges of the knife blade, such that in the clamped state they limit the range of movement of the knife blade on the holder; the positioning means for accurately positioning the knife blade and the clamp on the holder before tightening the fastening mechanism.

According to this disclosure a knife assembly is provided comprising a knife blade 101, 200, 400 of which a front edge 410 is a cutting edge, a holder 100, 201, 430 configured for supporting the knife blade 101, 200, 400, a clamp 102, 202, 420, 600 arranged for clamping the knife blade 101, 200, 400 onto the holder 100, 201, 430, and a fastening mechanism 103, 203 cooperating with the holder 100, 201, 430 and clamp 102, 202, 420, 600 for securing the knife blade 101, 200, 400 between the clamp 102, 202, 420, 600 and the holder 100, 201, 430 with the cutting edge 410 protruding at the front side whereby the clamp 102, 202, 420, 600 has a clamping line 120, 220, 440, 620 rearward from the front edge corresponding to a complementary contact line at the knife blade 101, 200, 400. The clamp 102, 202, 420, 600 comprises one or more clamping geometrical elements 115, 215, 450, 615 corresponding to complementary contact geometrical elements of the knife blade 101, 200, 400, the clamping geometrical elements 115, 215 450, 615 being positioned at least in part at a different distance, preferably further rearward, from said front edge than said clamping line 120, 220, 440, 620, such that in clamped state the clamp 102, 202, 420, 600 engages the corresponding contact geometrical elements 115, 215 450, 615 of the knife blade 101, 200, 400.

In accordance with this disclosure the knife assembly may be arranged such that in assembled but unclamped state the clamping geometrical elements 115, 215 450, 615 of the clamp 102, 202, 600 do not engage the corresponding contact geometrical elements 115, 215 450, 615 of the knife blade 101, 200, 400, and that in clamped state, i.e. with the fastening mechanism being tightened, the clamping geometrical elements 115, 215 450, 615 of the clamp 102, 202, 600 do engage the corresponding contact geometrical elements 115, 215 450, 615 of the knife blade 101, 200, 400.

Figure 18:
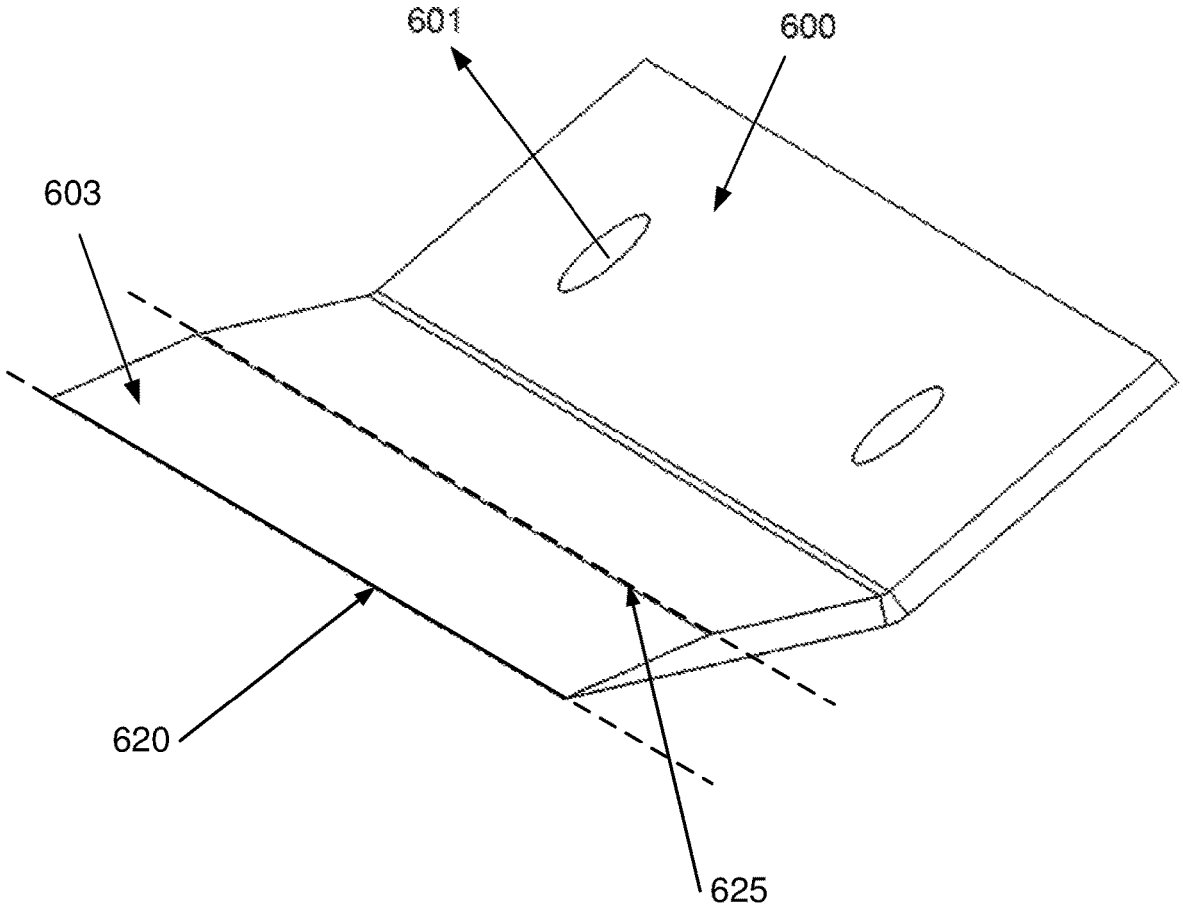
FIG. 18 shows an alternative clamp according to an embodiment of this disclosure suited for use with a flat surface knife blade.

In accordance with this disclosure a knife assembly may further be provided, an example of which is shown in FIG. 18, wherein said clamping line 120, 220, 440, 620 corresponds to a complementary contact line at the knife blade 101, 200, 400 defines a first clamping line 120, 220, 440, 620 and wherein said one or more clamping geometrical elements 115, 215, 450, 615 is a second clamping line 625 and possibly one or more third clamping lines (not shown) in between the first and second clamping lines. The clamping lines are preferably parallel to each other.

In accordance with this disclosure a knife assembly may be provided, examples of which is are shown in FIGS. 8-11 and FIGS. 16-17, wherein said clamping line 120, 620 corresponds to a complementary contact line at the knife blade 101 defining a first clamping line 120 620 and wherein said clamping geometrical element(s) 115, 615 is/are a clamping surface(s) 115, 615 of which said first clamping line 120, 620 is a part.

In accordance with this disclosure a knife assembly may be provided wherein the clamp 102, 202, 420, 600 comprises a first part defining the clamping line 120, 220, 440, 620 and a second part defining one or more geometrical elements 115, 215 450, 615.

In accordance with this disclosure a knife assembly may be provided wherein the clamp 102, 202, 420, 600 is constructed such that in unclamped state the clamping geometrical elements 115, 215 450, 615 are offset from the corresponding contact surfaces of the knife blade 101, 200, 400 and that in clamped state the clamping geometrical elements 115, 215 450, 615 engage the corresponding contact surfaces of the knife blade 101, 200, 400 with a predetermined clamping force.

In an embodiment of this disclosure the knife blade 101, 200 is a corrugated knife blade 101, 200 over a corrugated part having a continuous shape defining a periodic pattern of peaks and valleys over a certain distance.

In a further embodiment thereof the clamp 102, 202 has an inwardly corrugated shape 116 complementary to that of the knife blade 101, 200, preferably the clamp comprises a plurality of fingers, tips of which together form said first part while its rearward parts together form said second part, the fingers and tips defines said corrugated shape.

In an embodiment of this disclosure the clamp 102, 202 has an inwardly corrugated shape 116 complementary to that of the knife blade 101, 200, preferably the clamp comprises a plurality of fingers while its rearward parts comprise side surfaces of said fingers arranged for contacting slanted parts of the knife blade.

In an alternative embodiment of this disclosure the knife assembly provides for the knife blade 101, 200, 400 being a flat knife blade 101, 200, 400.

In accordance with this disclosure the clamping geometrical elements 115, 215, 450, 615 may be arranged such that in clamped state the clamp 102, 202, 420, 600 engages the corresponding contact geometrical elements of the knife blade 101, 200, 400 continuously over the entire length of the clamping geometrical elements 115, 215 450, 615.

In an embodiment of this disclosure the knife assembly has inwardly beveled parts 115 which are arranged to engage parts of the valleys of the knife blade 101, 200, 400.

In an embodiment thereof the inwardly beveled parts 115 have a length of at least 1 mm, preferably at most 20 mm, more preferably at most 15 mm, and more preferably at most 10 mm.

In an embodiment of this disclosure the clamp 102, 202 comprises stop parts 204 arranged to engage rear edges 108, 205 of the knife blade 101, 200, such that in the clamped state the stop parts 204 limit the range of movement of the knife blade 101, 200 on the knife holder 100, 201.

In an embodiment of this disclosure the fastening mechanism 103, 203 comprises a plurality of fixing elements cooperating with a plurality of bores 106 provided on the holder 100, 201 and/or clamp 102, 202.

In an embodiment thereof the fixing elements provide stopping elements 107 arranged for engaging the rear edges 108, 205 of the knife blade, such that in the clamped state the stopping elements 107 limit the range of movement of the knife blade 101, 200 on the holder 100, 201.

In a further embodiment thereof each of the stopping elements 107 comprises portions 109 arranged for engaging the rear edges 108, 205 of the knife blade 101, 200 at a predetermined location and shaped for pushing it down on the holder 100, 201. In an embodiment, this shaped portion can be a tapered portion, it can be axially concave or axially convex, depending on the shape of the knife blade that is to be engaged.

In an embodiment in accordance with this disclosure the clamp is constructed such that in unclamped state the clamping geometrical elements, in particular the beveled parts 115, are offset from the corresponding contact surfaces of the knife blade 101, 200 and that in clamped state the clamping geometrical elements, in particular the beveled parts 115, engage the corresponding contact surfaces of the knife blade 101, 200 with a predetermined clamping force. This offset is predetermined, chosen such that upon tightening the fastening means to the clamped state, the beveled parts 115 substantially entirely and continuously contact the corresponding contact surfaces of the knife blade.

In an embodiment in accordance with this disclosure the knife blade 101, 200, 400 in the clamped state extends over an edge of the holder 100, 201, 430 by a predetermined distance.

In a further embodiment thereof the knife blade 101, 200, 400 in the clamped state extends over the edge of the holder 100, 201, 430 by at least 1 mm, preferably at most 4 mm, more preferably at most 3 mm, more preferably 2.5 mm.

In accordance with this disclosure the holder 100, 201, 430 may comprise a back surface 111 having a continuous corrugated shape over a certain distance corresponding to the corrugated shape of the knife blade 101, 200, 400.

This disclosure further provides a cutting system 300, with at least one knife assembly positioned along the circumference of the cutting system.

In an embodiment thereof; this cutting system, also denoted a drum, has one knife assembly and is stationary, food product being fed to the drum and rotated therein by means of for example an impeller, so that the food product is pushed against the circumference of the drum by centrifugal force and cut by the knife assembly. Further cutting tools may be positioned downstream from the knife assembly to further reduce the food product.

This disclosure further provides a cutting head 300 with at least two knife assemblies 301, 302, for example as discussed above, positioned along the circumference of the cutting head 300 for cutting products fed into the cutting head 300, the cutting head 300 being adapted to be rotatably fitted to a base.

This disclosure further provides an apparatus for cutting products, comprising: a base; a cutting head 300 as described above with knife assemblies positioned along the circumference of the cutting head 300 for cutting products fed into the cutting head 300, the cutting head 300 being rotatably fitted to the base; an impeller adapted for rotating concentrically within the cutting head 300 to urge products fed into the cutting head towards the circumference of the cutting head 300 by means of centrifugal force; a drive mechanism for driving at least the impeller at a first rotational speed.

In an embodiment thereof the apparatus comprises a second drive mechanism for driving the cutting head 300 at a second rotation speed, wherein the second rotational speed being different from the first rotational speed of the impeller.

FIG. 1 shows a prior art knife assembly equipped with a corrugated knife blade 101 positioned on a holder 100 at a slanted direction. The knife blade 101 is secured to the knife holder 100 by means of a clamp 102 and a plurality of fasteners 103. The clamp has a plurality of fingers, the tips of which are arranged to contact the knife blade 101 (along a clamping line 120).

Figure 25:
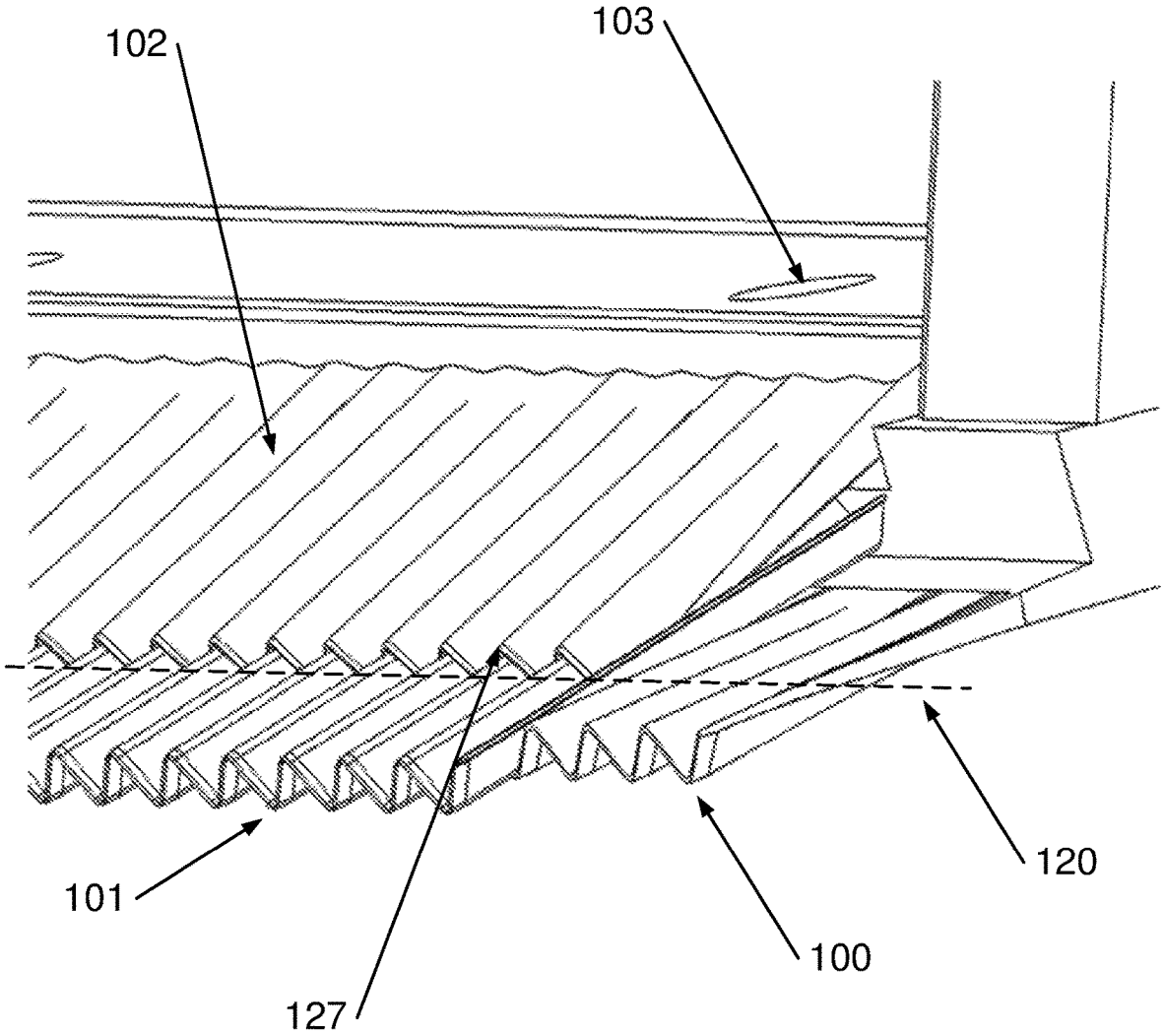
Fig. 25 (prior art)
FIG. 25 shows another prior art knife assembly.

FIG. 25 shows another prior art knife assembly. The parts (holder, knife and clamp) are formed from straight to corrugated shape by press forming. The contact between clamp and knife is only partly along the front line. Gaps 127 are present between the knife and the clamp. It has been found that this disadvantageously allows food product to force its way in and eventually spread the gap, which is undesirable.

Figure 2:
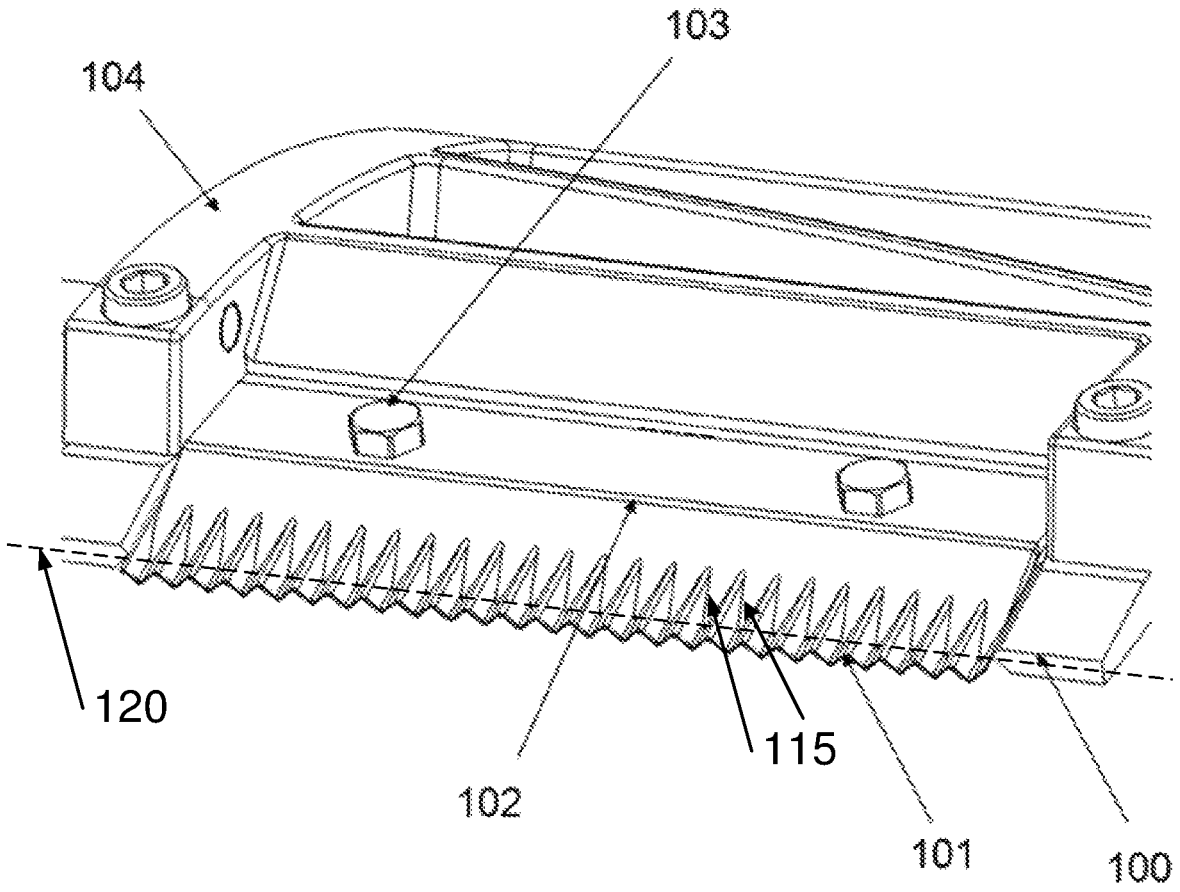
FIG. 2 shows an embodiment of a knife assembly according to this disclosure.

FIG. 2 shows an embodiment of a knife assembly according to this disclosure. In this embodiment, the clamp 102 can be arranged so that it engages the knife blade 101 over a longer contact surface, thereby significantly reducing or eliminating the movement (swinging) of the knife blade 101 during cutting of food products.

Figure 3:
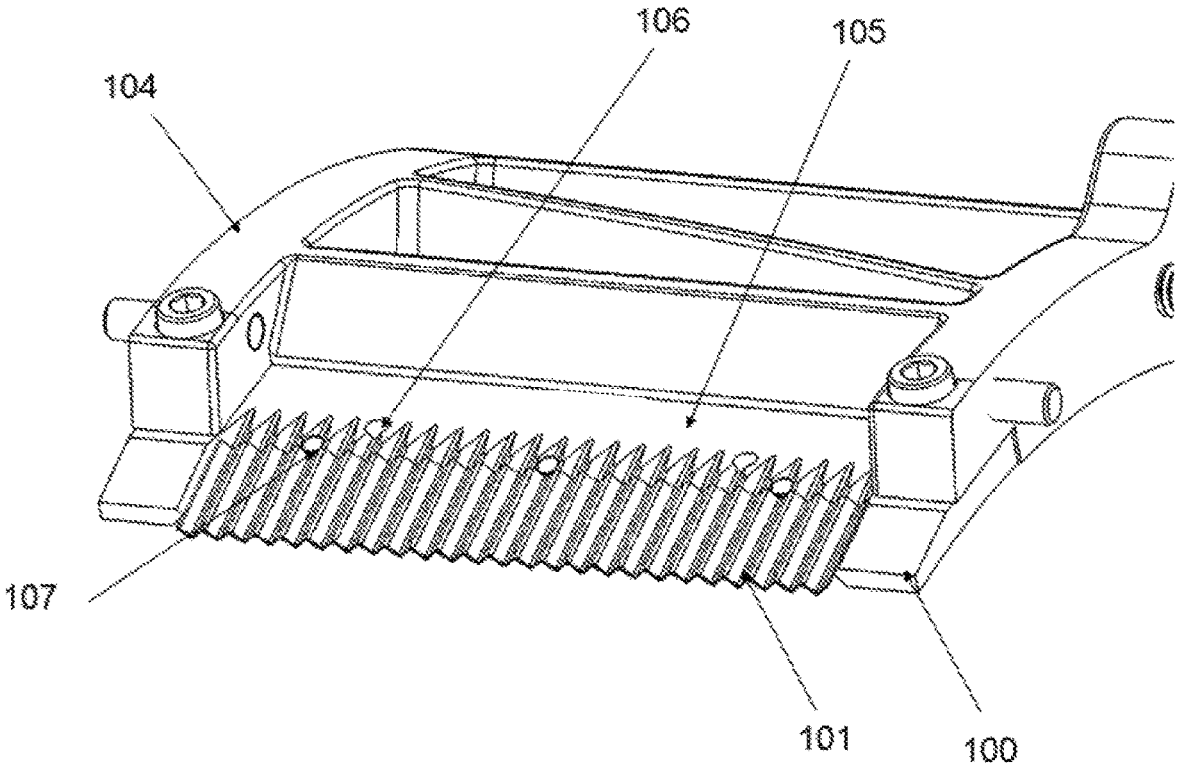
FIG. 3 shows a knife blade, a holder and a shoe of the knife assembly of FIG. 2.
Figure 5:
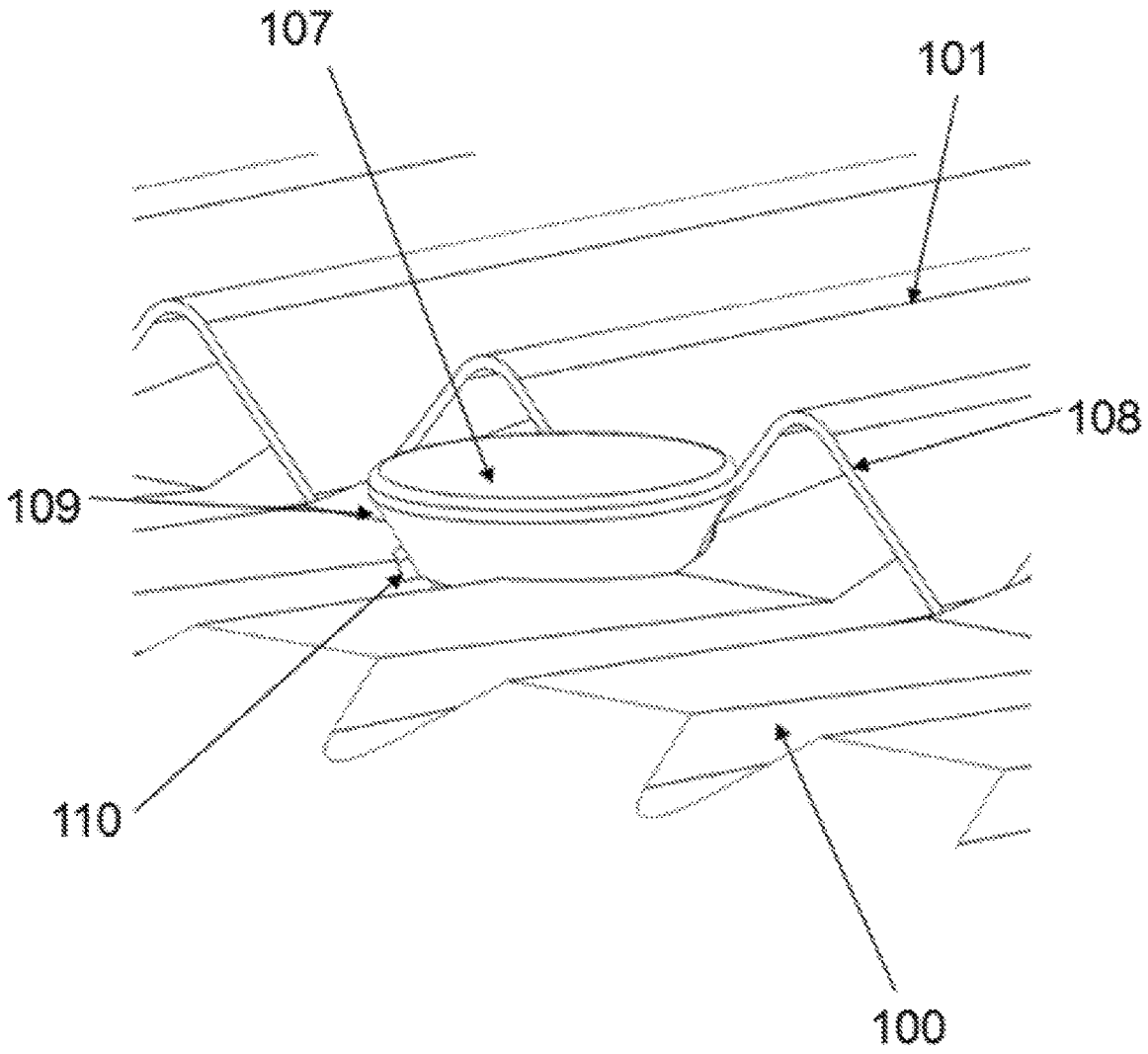
FIG. 5 shows a detail of part of the knife assembly of FIG. 2.

The knife assembly shown in FIG. 2 comprises a holder 100, which has a corrugated shape arranged for supporting a corrugated shaped knife blade 101 and a clamp 102 configured for clamping the knife blade 101 on the holder 100. The knife blade 101 can be secured between the clamp 102 and the holder 100 by means of a fastening mechanism having a plurality of fixing elements 103, e.g. bolts arranged to cooperate with matching bores. Furthermore, the knife assembly may be attached to a shoe 104 of a cutting apparatus, such as the cutting apparatuses presented on FIGS. 14-15. As shown in FIG. 3 the holder 100 may be provided with bores 106 arranged for receiving the fixing elements 103 of the fastening mechanism for securing the knife blade between the clamp 102 and the holder 100. The knife blade may be arranged so that it extends from an edge of the holder by a predetermined distance, as shown in FIG. 2 and further in FIG. 10. This distance usually determines the thickness of the sliced food product and should remain constant during cutting of the food product; otherwise the product may not be cut evenly, thereby significantly reducing the production yield. In order to maintain the distance by which the knife blade extends over the holder, a plurality of stopping elements 107 may be provided on the holder 100 at specific locations. The stopping elements 107 can be used to engage a rear edge 108 of the knife blade, as shown in FIG. 5, such that the range of movement of the knife blade 101 on the holder 100 can be limited. In other words, the stopping elements 107 may function as a backstop preventing the movement of the knife blade 101 during cutting of food products in at least one direction, e.g. lateral direction. The stopping elements 107 may further be provided with tapered portions 109 arranged for engaging the rear edges 108 of the knife blade 101 and push the knife blade 101 down on the holder 100, thereby limiting the range of movement of the knife blade 101 on the holder 100. The shape of the stopping elements 107 may be further arranged to correspond to a complementary shape of matching bores 110 provided on the holder 100, thereby enabling the stopping elements 107 to be locked into the predetermined locations on the holder 100 and ensuring they do not become loose during cutting of food products. In embodiments according to this disclosure the stopping elements 107 may be part of the fastening mechanism.

Figure 4:
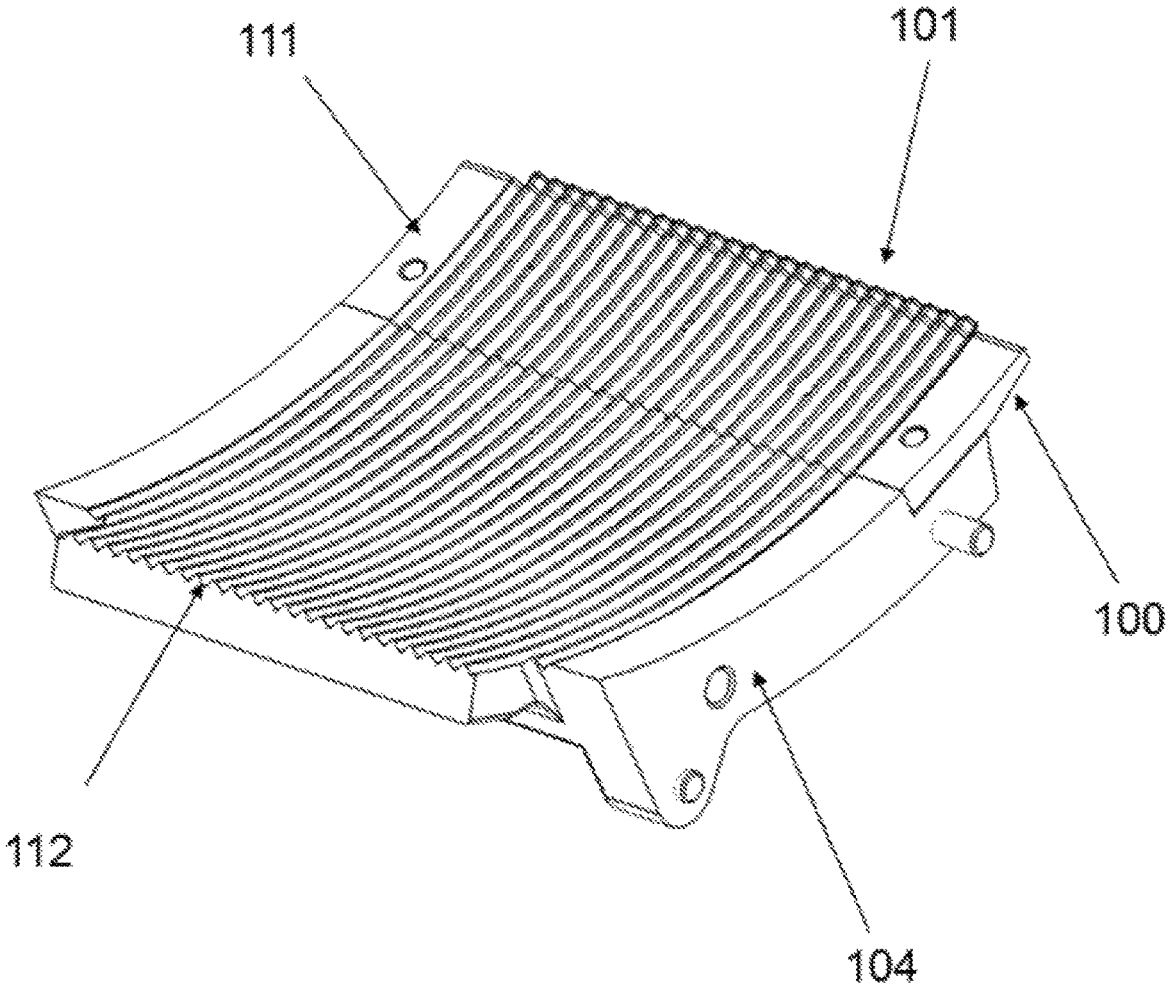
FIG. 4 shows the back surface of the holder and shoe of FIG. 3.

In embodiments of this disclosure, the holder 100 may be further provided with a back surface 111 having a corrugated shape, which may be arranged to match the corrugated shape of the knife blade 101, as shown in FIG. 4. Furthermore, the shoe 104 may be also provided with a corrugated shape, which preferably matches the corrugated shape of the holder 100. This configuration of the back surface of the holder 100 and the shoe 104 may provide relief from stones entering the cutting apparatus along with the product to be sliced and can avoid that such stones damage the knife blade. Further, the grooves of the corrugated shape may reduce friction between the product rotating inside the cutting apparatus and the back surface of the holder.

Figure 6:
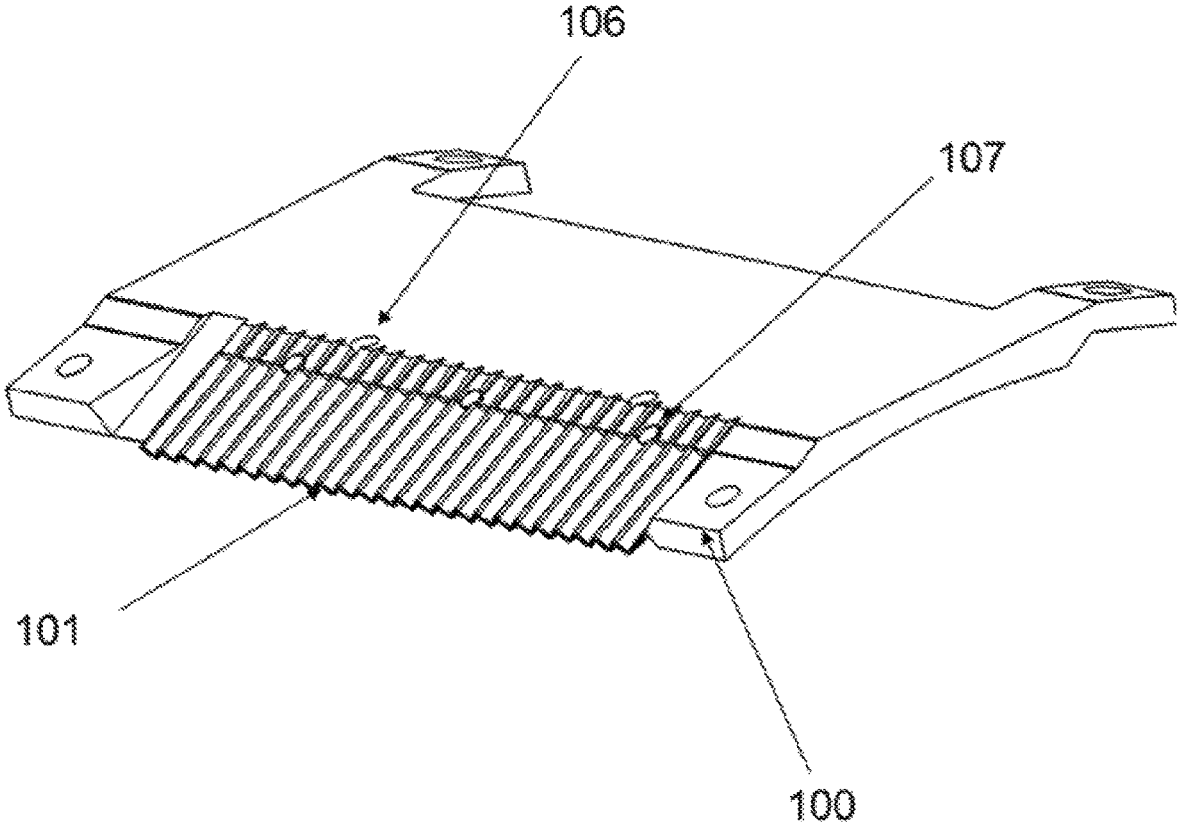
FIG. 6-7 show different views of an alternative embodiment of a holder according to this disclosure.
Figure 7:
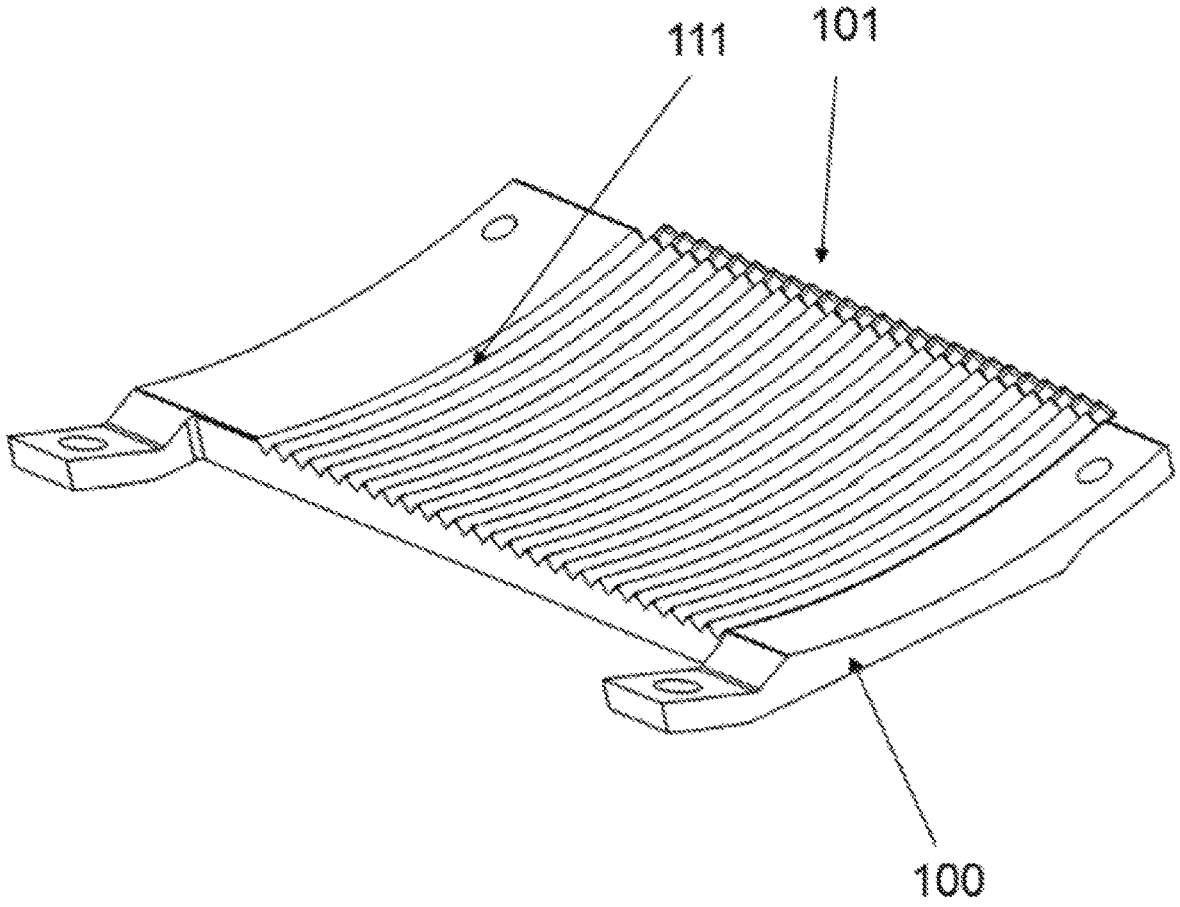

An alternative embodiment of the holder 100 is shown on FIG. 6 and FIG. 7. The main difference with previously presented embodiments, shown in FIGS. 2 to 4, is that the shoe 104 in this case is integrated with the holder 100, thereby forming a single part that can be attached to a cutting apparatus, such as the one presented in FIGS. 14 and 15. An additional advantage of this integrated solution is that the holder 100 here has space to accommodate a clamp (not shown) which extends further back, i.e. has an extended part rearward from the fastening screws 103 (in the embodiment of FIG. 2 such an extension is not possible because of the ridge behind the clamp). This has the advantage that fulcrum point for the fastening screws 103 is in a better position. In common, prior art knife assemblies, the screws are in a position of about 70:30 ratio, i.e. they are closer to the back of the clamp than to the front edge. This means that the screw only applies 30% of its force on the foremost part of the clamp. The holder 100 of FIGS. 6 and 7 can accept a larger clamp, i.e. a clamp which extends further back, and improve the ratio to e.g. 50:50, meaning that the screws 103 are about halfway between the back of the clamp and its foremost part.

Figure 8:
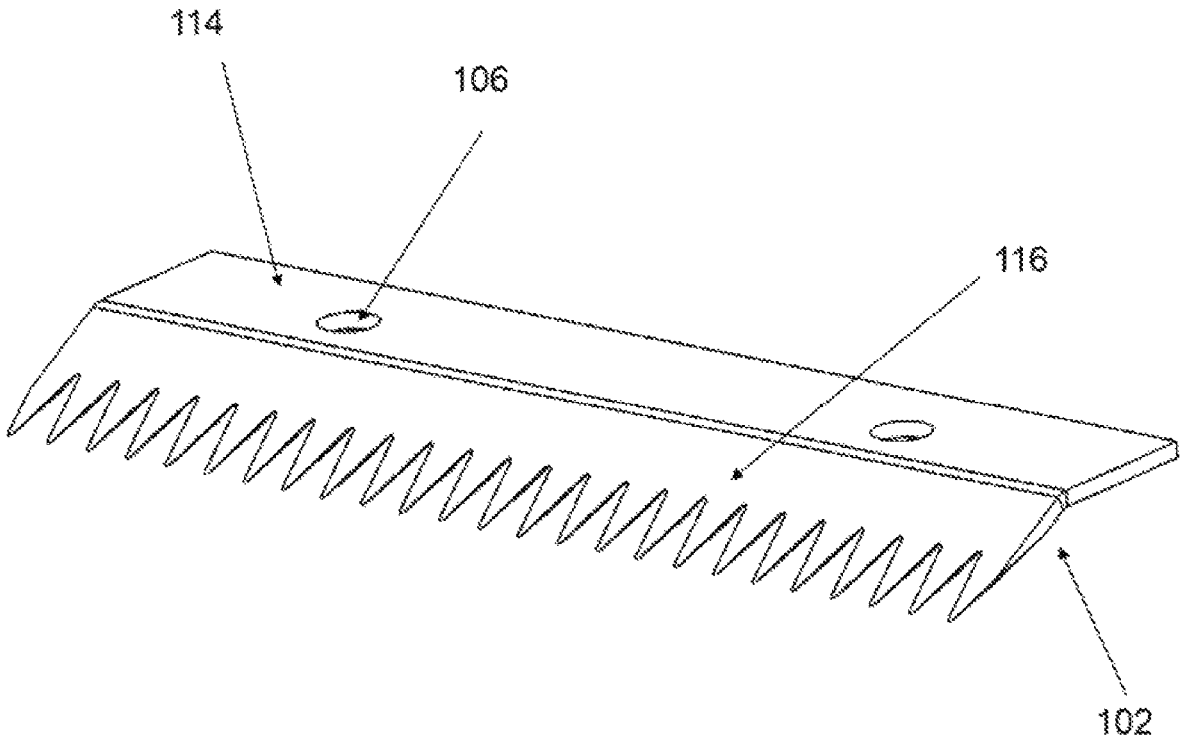
FIG. 8-9 show different views of a clamp of the knife assembly of FIG. 2.
Figure 9:
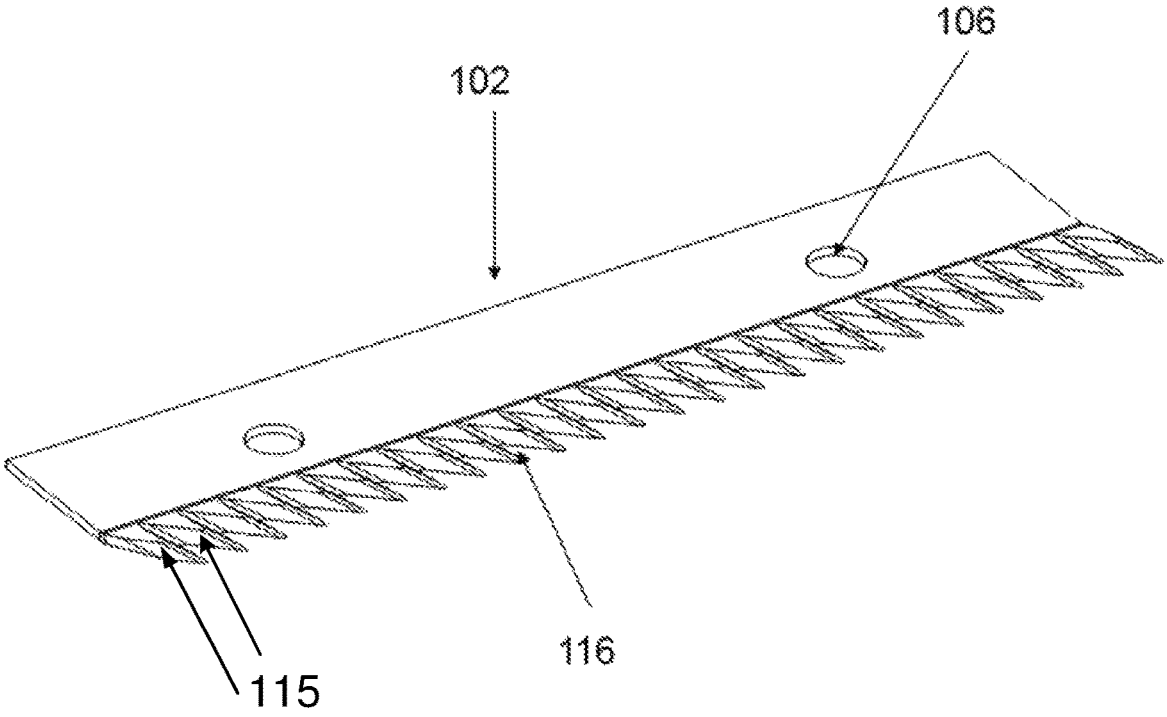

FIGS. 8-9 show an embodiment of a clamp 102 according to this disclosure. The clamp 102 comprises a slanted part 113 projecting from a flat portion 114, such that in the clamped state the slanted part 113 can be arranged for engaging the knife blade at predetermined locations. The flat portion 114 of the clamp may be provided with bores 106 arranged for receiving the fixing elements 103 of the fasting mechanism for securing the knife blade 101 between the holder 100 and the clamp 102. The clamp 102 comprises clamping geometric elements 115, which can be defined for example as inwardly beveled parts, which may define clamping surfaces corresponding to complementary contact surfaces of the knife blade 101. As shown in the cross-sectional views of FIGS. 10 and 11, the inwardly beveled parts 115 may extend over a certain length. FIG. 11*a* shows the clamped state, and FIG. 11*b* shows the unclamped state.

In embodiments according to this disclosure, the length of the inwardly beveled parts 115 (measured in direction perpendicular to the front edge) may be at least 1 mm, preferably at most 20 mm, more preferably at most 15 mm, and even more preferably at most 10 mm.

In embodiments according to this disclosure, the inwardly beveled parts 115, or the geometrical elements in general, can be arranged to match, in the clamped state, the contact surfaces of the knife blade 101, such that the clamp 102 engages the corresponding contact surfaces of the knife blade 101 continuously over the entire length of the inwardly beveled parts 115. This configuration of the clamp 102 may enable the knife blade to be securely clamped over a longer contact surface, thereby significantly reducing the movement of the knife blade during cutting of food products with respect to the prior art.

In embodiments of this disclosure, the inwardly beveled parts 115 in the unclamped state, wherein the clamp has not been tightened to the holder, may be offset from the contact surfaces of the knife blade. This offset is predetermined, chosen such that upon tightening the fastening means to the clamped state (see for example FIGS. 11 and 21), the beveled parts 115 substantially entirely and continuously contact the corresponding contact surfaces of the knife blade.

Figure 10:
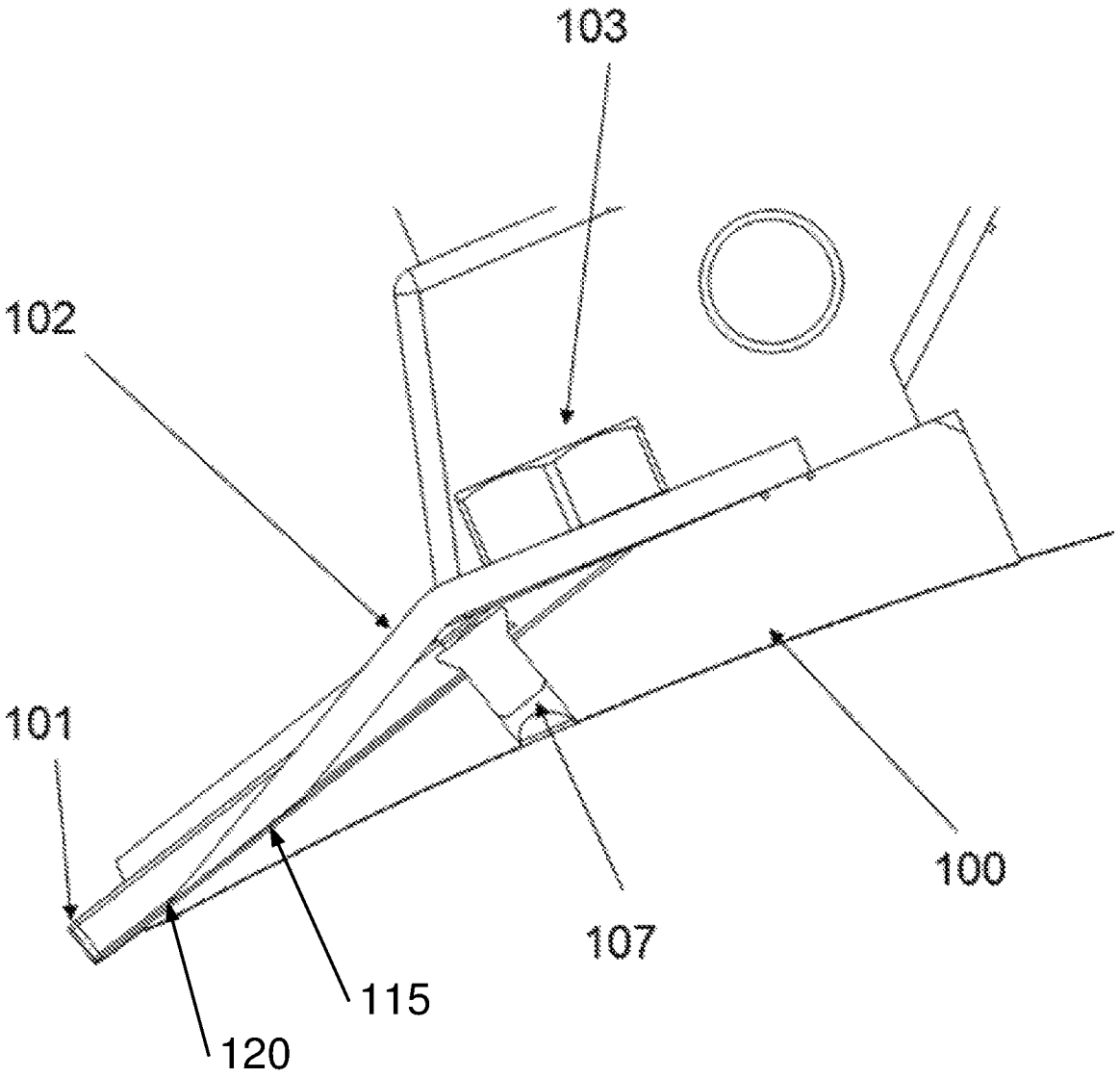
FIG. 10 shows a cross-sectional view of the knife assembly of FIG. 2.
Figure 11A:
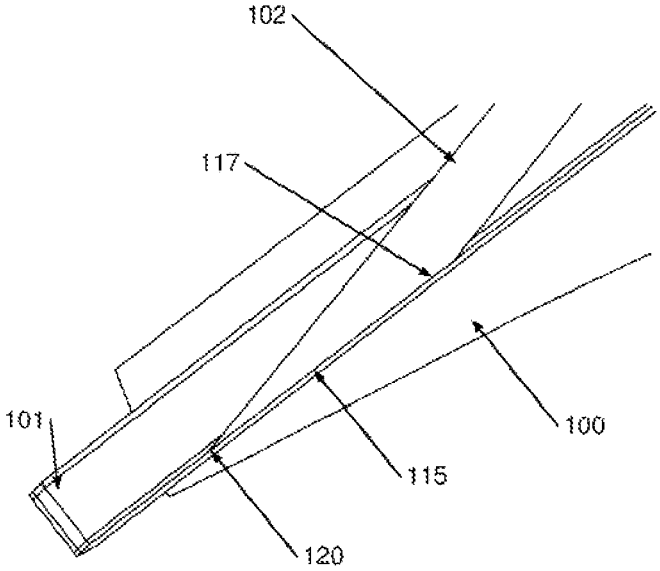
FIGS. 11*a*-11*b* show a detail of FIG. 10.
Figure 11B:
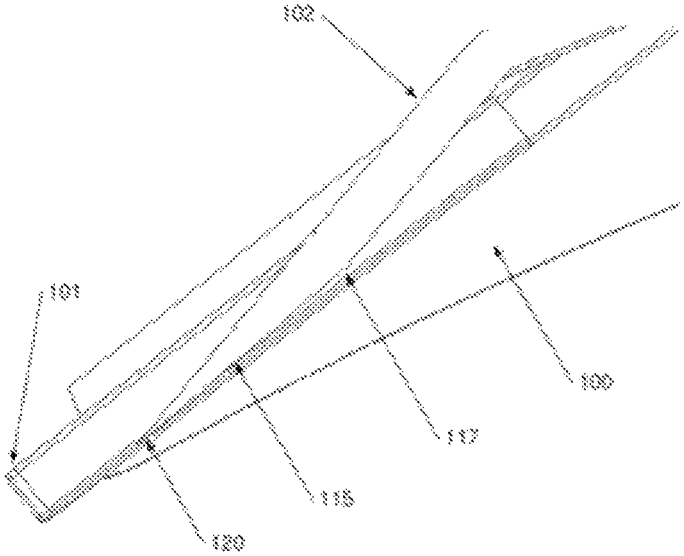

In embodiments according to this disclosure, the clamp 102 may be arranged so that each of the clamping geometrical elements 115, 215, 450 and 650 engages a respective valley of the knife blade, as shown in FIG. 2 and FIG. 10. This configuration may ensure that the clamp exerts an equal amount of pressure across the entire surface of the knife blade 101.

In alternative embodiments (not shown) according to this disclosure, other clamping configurations known to the skilled person in the art may also be considered. For example, an alternating clamping configuration may be used, wherein the inwardly beveled parts 115 engage every other valley of the knife blade 101, or similar configurations.

In embodiments of this disclosure, the clamp 102 may be further provided with an inwardly corrugated shape corresponding to that of the knife blade 101. The corrugated shape can be provided on the back surface of the clamp 102 over a portion of the slanted part 105, as shown in FIG. 8 and FIG. 9. This configuration may enable, in the clamped state, the clamp 102 to engage in addition to the valleys, other locations of the knife blade 101 e.g. the peaks and/or the slanted parts in between, thereby better securing the knife blade 101 to the holder 100 with respect to the prior art.

Figure 12:
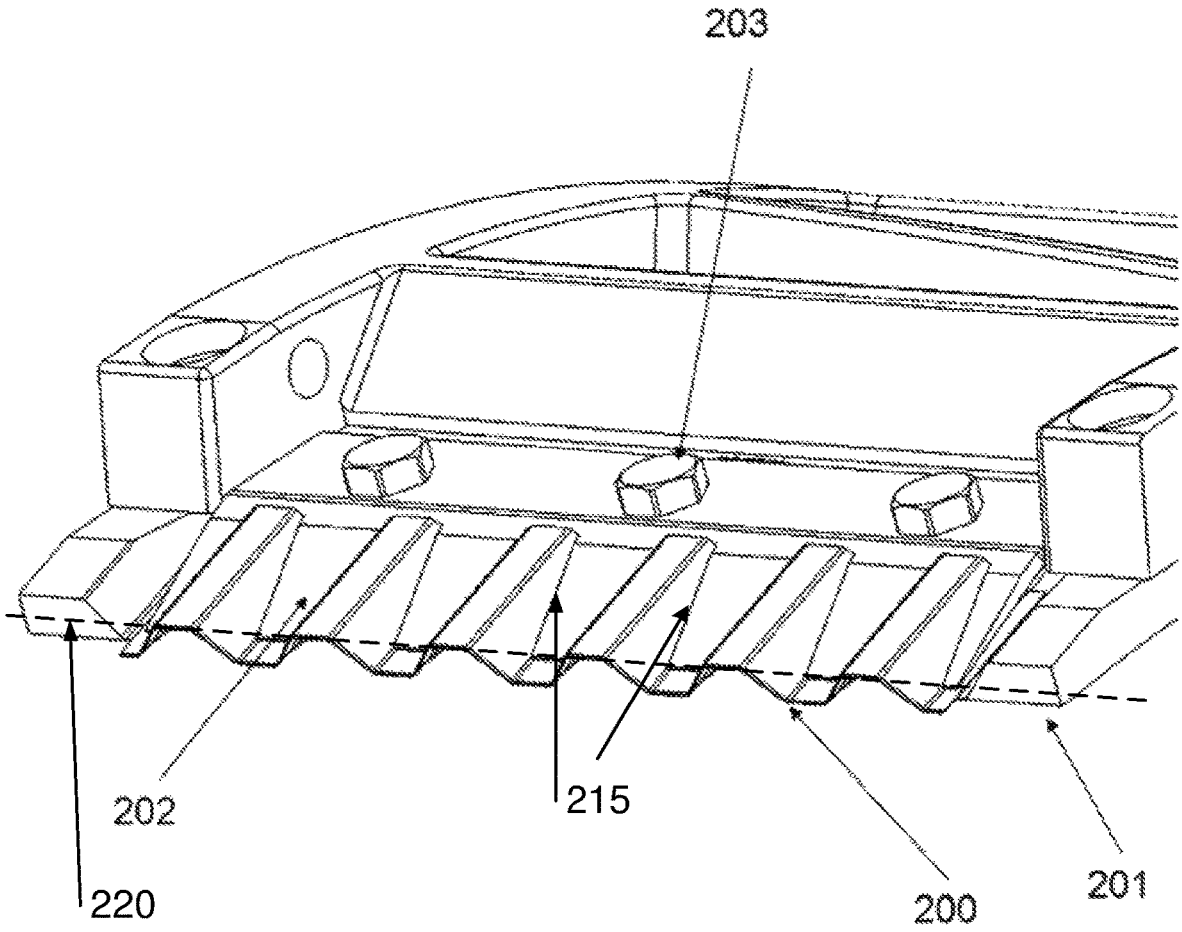
FIGS. 12-13 show an alternative embodiment of a knife assembly according to this disclosure.
Figure 13:
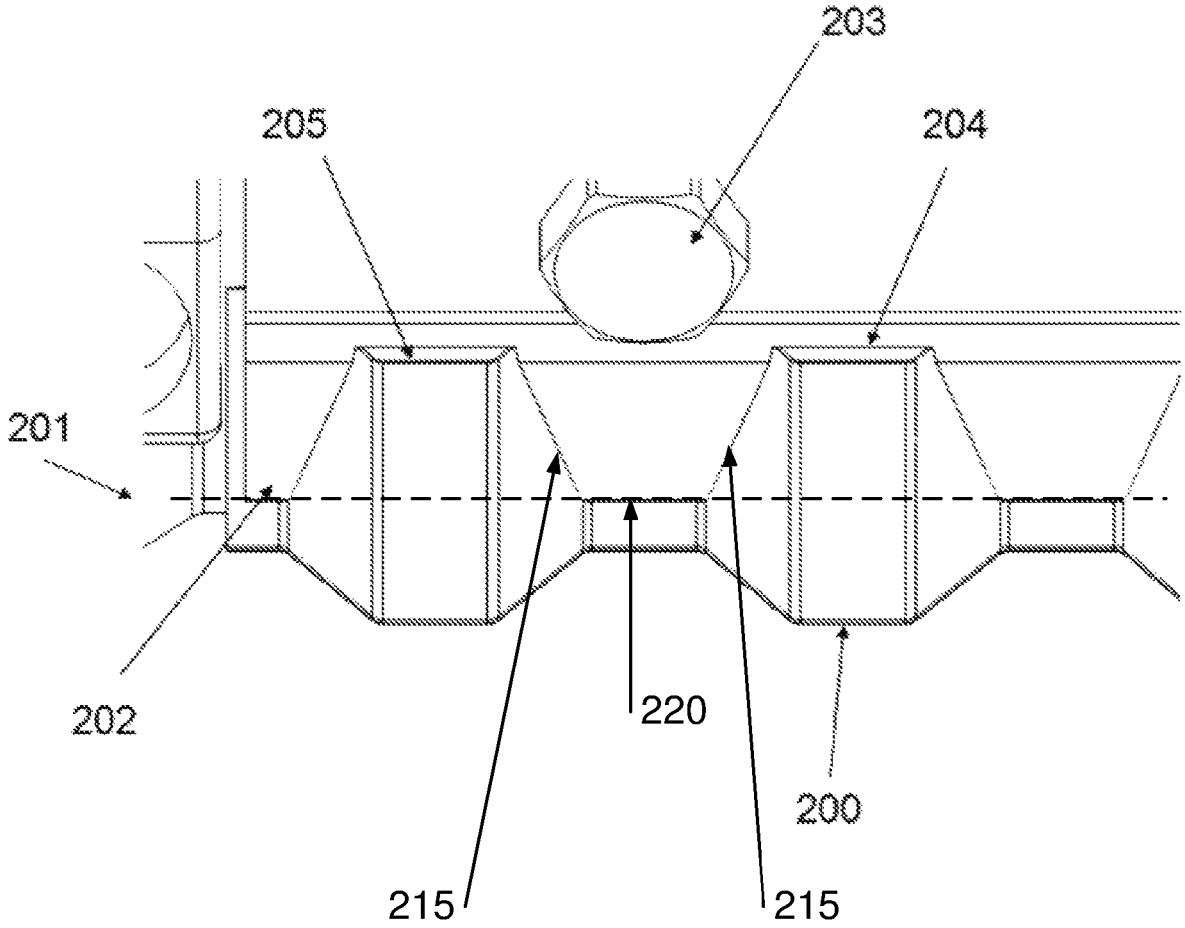

FIGS. 12 and 13 show an alternative embodiment of a knife assembly according to this disclosure. In this embodiment the corrugated shape of the knife blade 200 has a substantially trapezoidal shape having cross-sections with large amplitude. For example, the amplitude of the knife blade 200 corrugations may be of at least 1.0 mm, preferably at most 20.0 mm, and more preferably at most 10.0 mm. The holder 201 may be provided with a corrugated shape suitable for supporting the knife blade 200. As in the previous embodiments of this disclosure, a clamp 202 may be used for securing the knife blade 200 on to the holder 201 by means of a fastening mechanism 203 comprising a plurality of fixing elements, e.g. bolts. The clamp 202 of this embodiment may be provided with stopping parts 204 arranged to engage rear edges of the knife blade 200, as shown in FIG. 13. The stopping parts 204 may function as a backstop for preventing the movement of the knife blade in at least one direction, e.g. lateral, during cutting of food products. In embodiments according to this disclosure, the stopping parts 204 may be used in combination with the stopping elements 107. As with previous embodiments of this disclosure, the clamp 202 may be provided with inwardly beveled parts defining clamping surfaces that correspond to contact surfaces of the knife blade, thereby enabling the knife blade 200 to be clamped by the clamp 202 over a larger contact surface.

Figure 16:
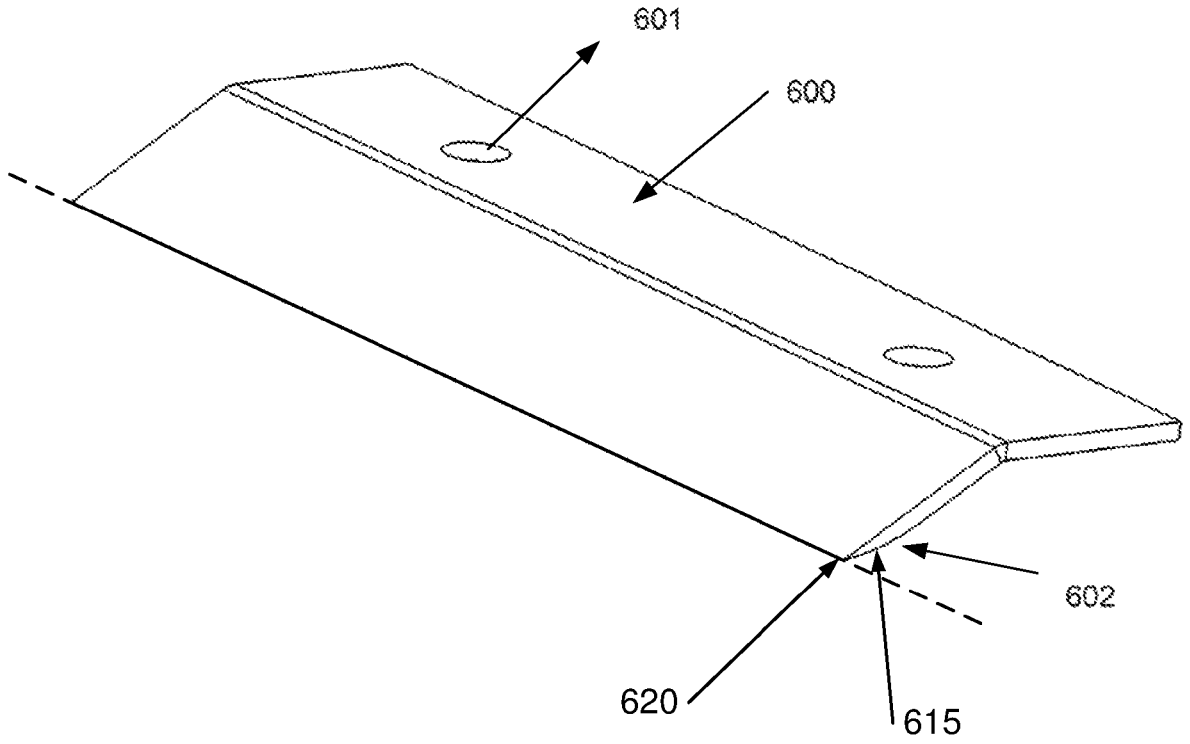
FIGS. 16-17 shows views of a clamp according to an embodiment of this disclosure suited for use with a flat surface knife blade.
Figure 17:
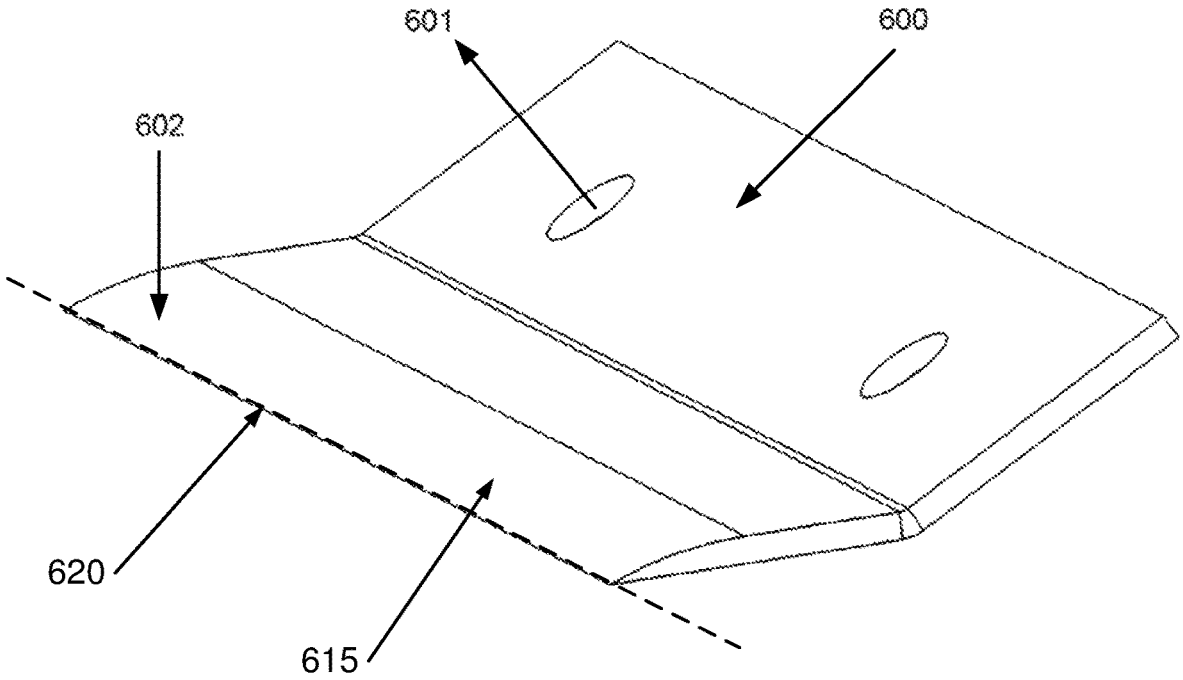
Figure 19:
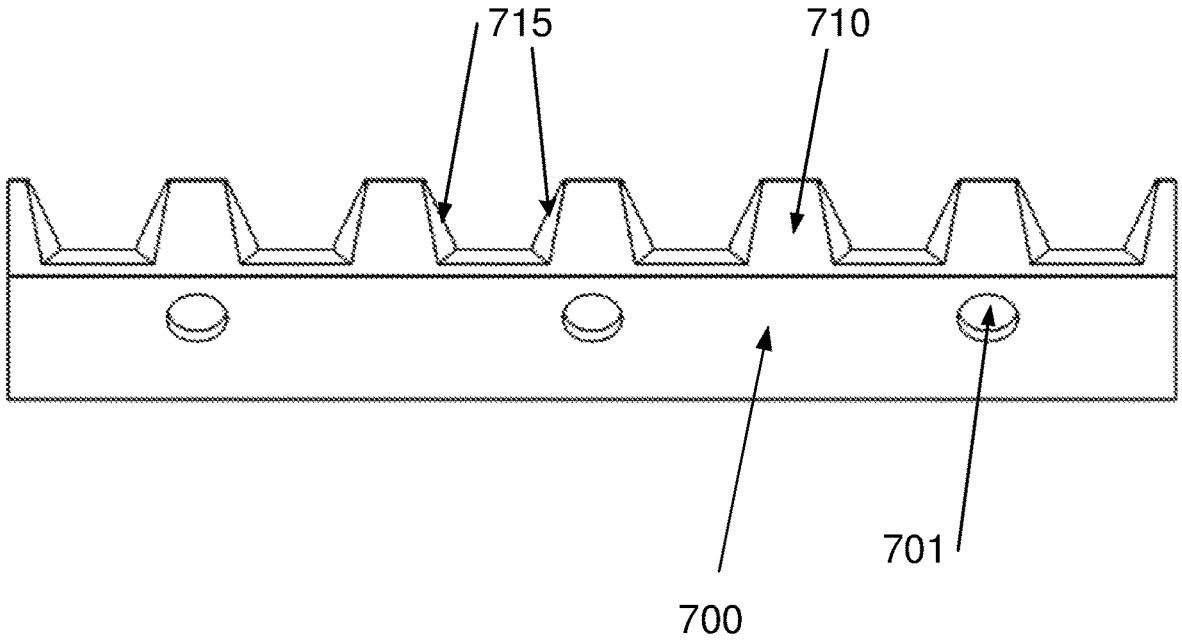
FIG. 19 shows a clamp according to an embodiment of this disclosure.
Figure 20:
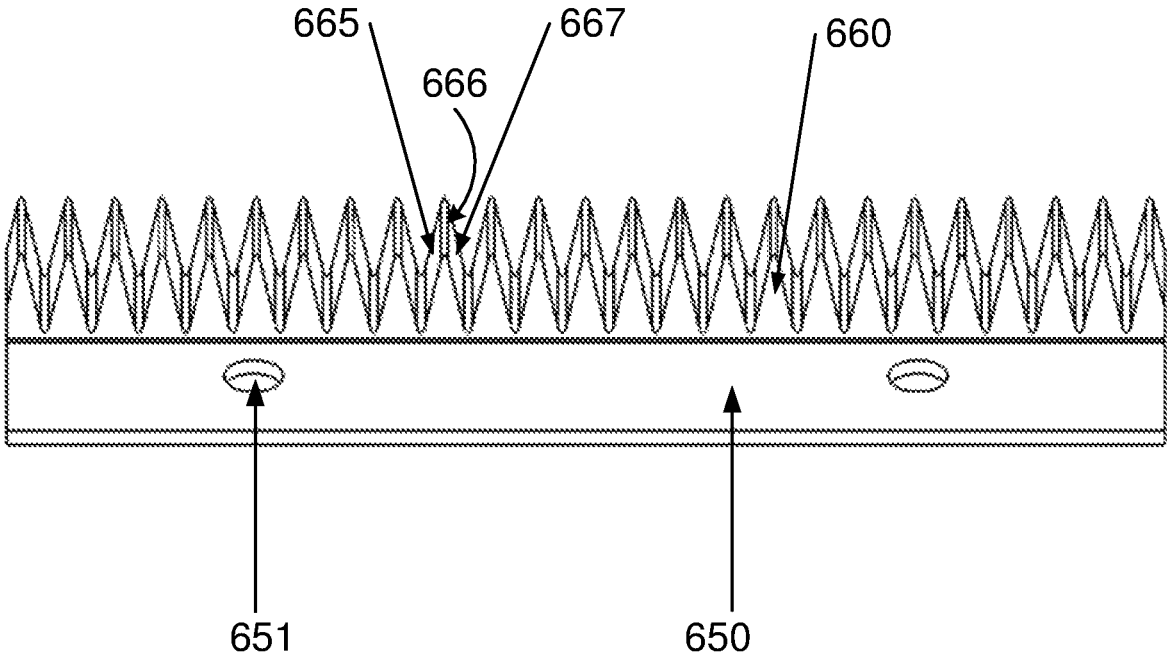
FIG. 20 shows a clamp according to an embodiment of this disclosure.
Figure 21:
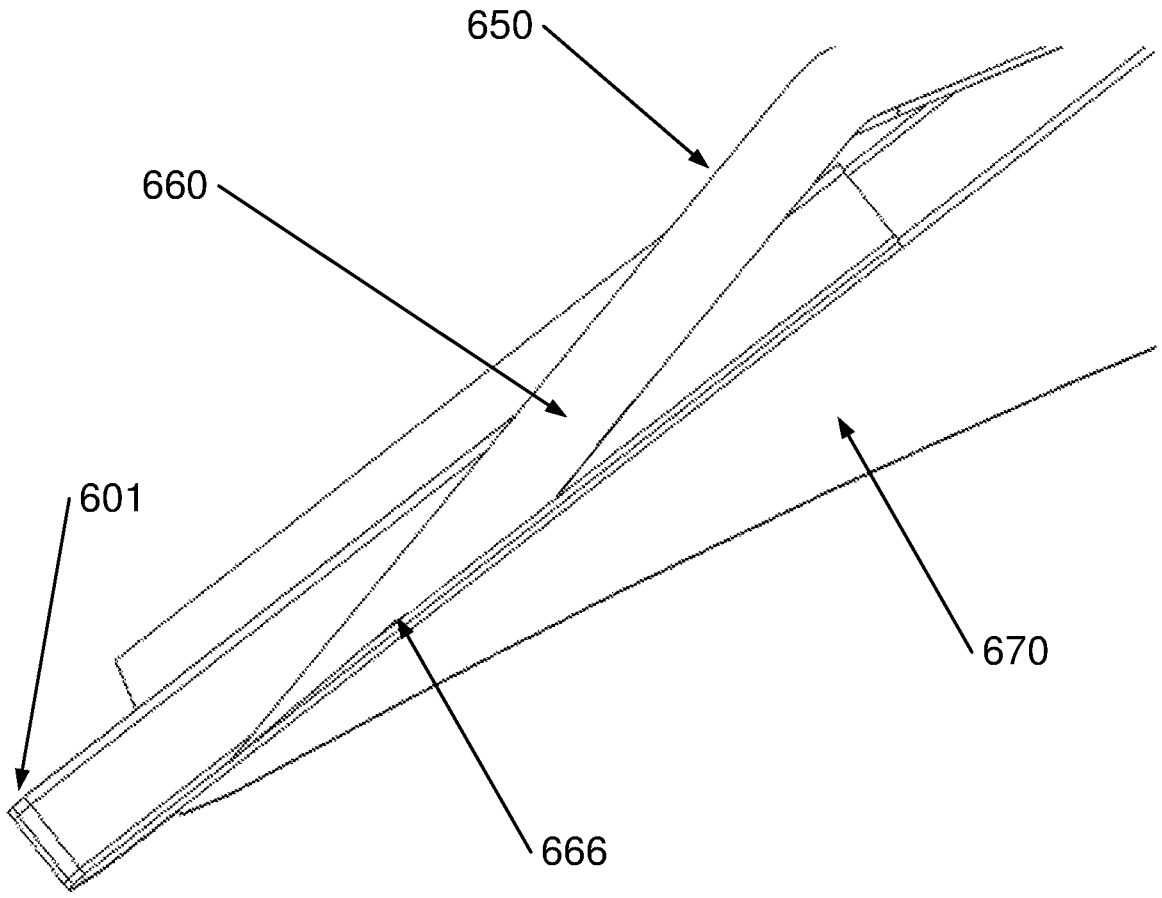
FIG. 21 shows a cross-sectional view of a knife assembly in the clamped state according to an embodiment of this disclosure.
Figure 22:
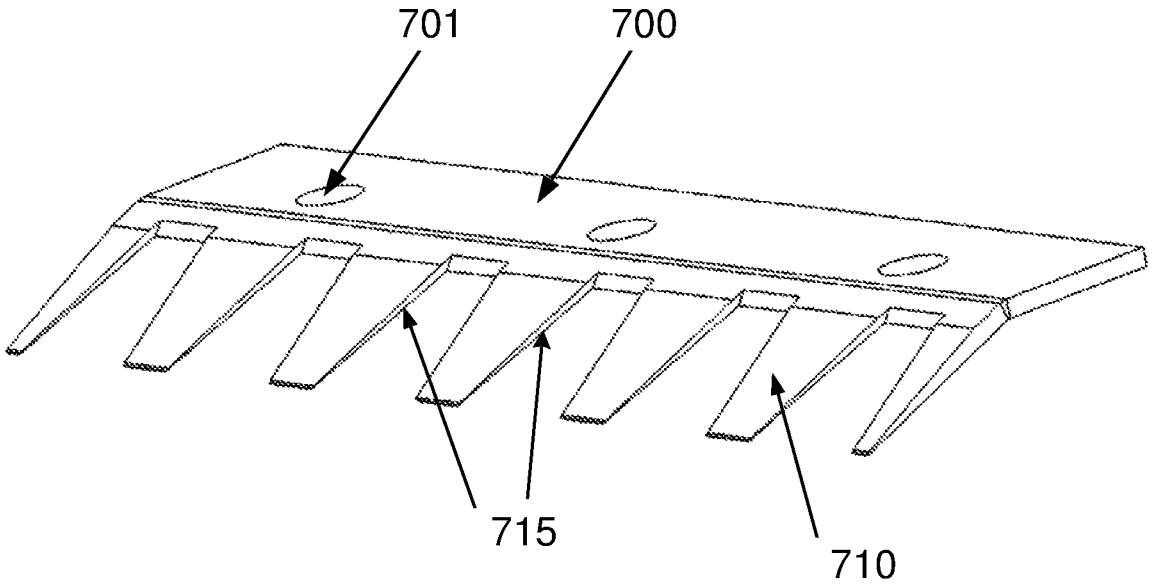
FIG. 22 shows a clamp according to an embodiment of this disclosure.
Figure 23:
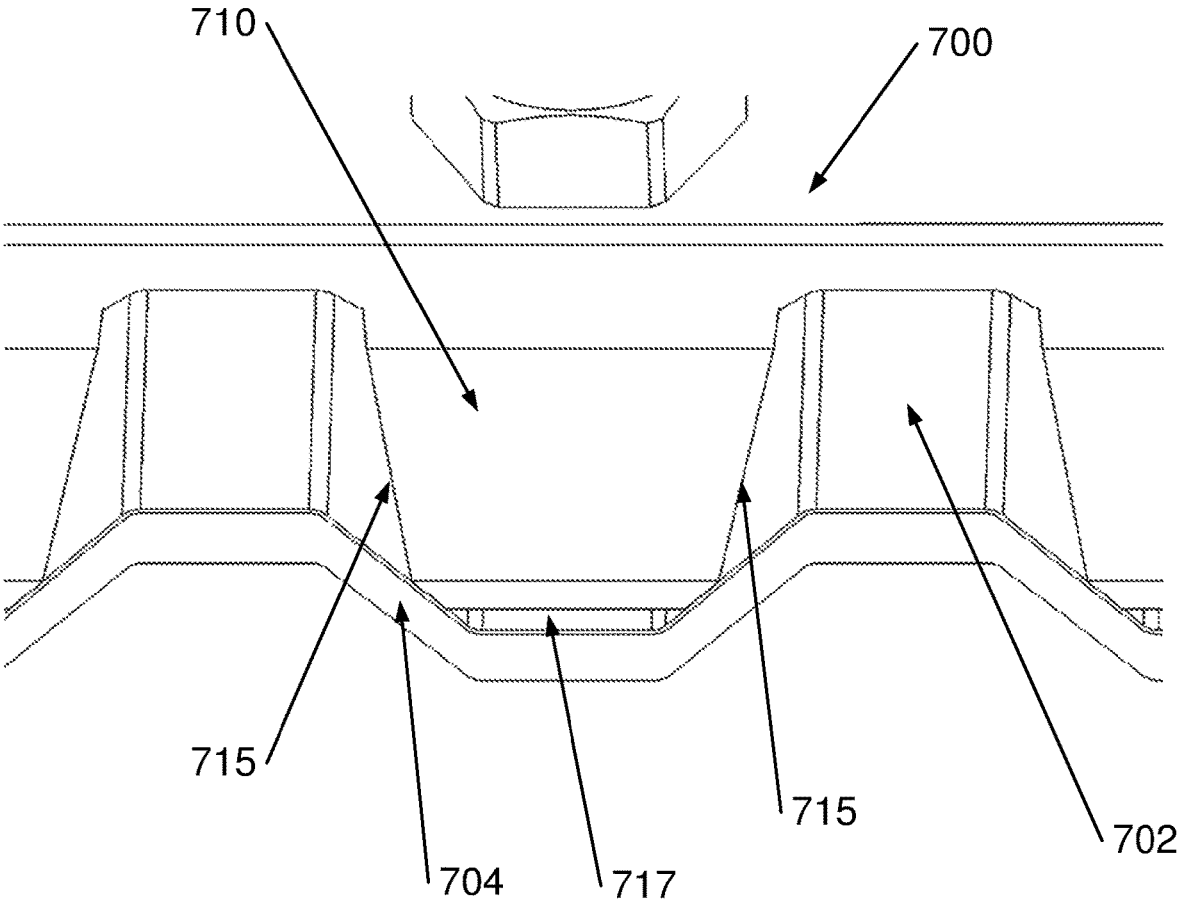
FIG. 23 shows a cross-sectional view through the knife assembly of FIGS. 12-13.

FIGS. 16 to 18 show a clamps 600 with bores 601 according to this disclosure, for clamping flat knife blades. FIGS. 16, 17 each show a portion 602 with a radius that will touch the knife blade entirely (the holder is complementarily curved) while FIG. 18 shows a flat portion 602 that would touch on two lines, at the point 620 and at the heel 625 of the beveled part 603. FIGS. 19, 22 and 23 show different views of a clamp 700, similar to the clamp 202 of FIGS. 12-13. The clamp has fingers 710 extending outwardly in a slanted direction from a flat portion of the clamp 700, where the bores 701 for the fastening mechanism are provided. The fingers 710 are provided with clamping geometrical elements 715 arranged to engage a corrugated knife blade 702 at predetermined locations. FIGS. 20 and 21 show different views of a clamp 650, similar to the clamp 102 of FIGS. 8-11. The clamp has fingers 660 extending outwardly in a slanted direction from a flat portion of the clamp 650, where the bores 651 for the fastening mechanism are provided by which the clamp is fastened to the holder 670. The fingers 660 are provided with clamping geometrical elements, in particular slanted surfaces 665, 667 and tip surfaces 666, arranged to engage a corrugated knife blade 601 at predetermined locations. In all these cases the knife would be held in at least two places instead of only along a single clamping line at the foremost edge of the clamp.

FIG. 23 shows a cross-sectional top view through a knife assembly embodiment according to this disclosure, in particular the embodiment with the clamp 700 of FIGS. 19 and 22. As shown, the clamp is shaped such that in clamped state the clamp tightly fits over the knife blade over its entire width. In particular, the clamp 700 is provided with fingers 710 arranged for engaging a corrugated knife blade 702 at the tip (not shown) and having clamping geometrical elements 715 arranged to engage the corrugated knife blade on the sidewalls of the valleys formed by the corrugated shape of the knife blade 702. The fingers 710 can be arranged in a slanted direction, such that a cavity 717 may be present between the knife blade 702 and the clamp 700 near the rear edge of the clamp 700. This cavity 717 is substantially sealed off at the top side by the fingers 710 touching the knife blade at their tips and along their sides. In other words, at the first line of contact of the clamp with the product being cut, the fit is such that particles of product being cut are prevented from entering the cavity. Also in the other embodiments of this disclosure shown in the figures, the clamp fits tightly over the knife blade to the extent that particles of product being cut are prevented from penetrating between the knife blade and the clamp.

Figure 14:
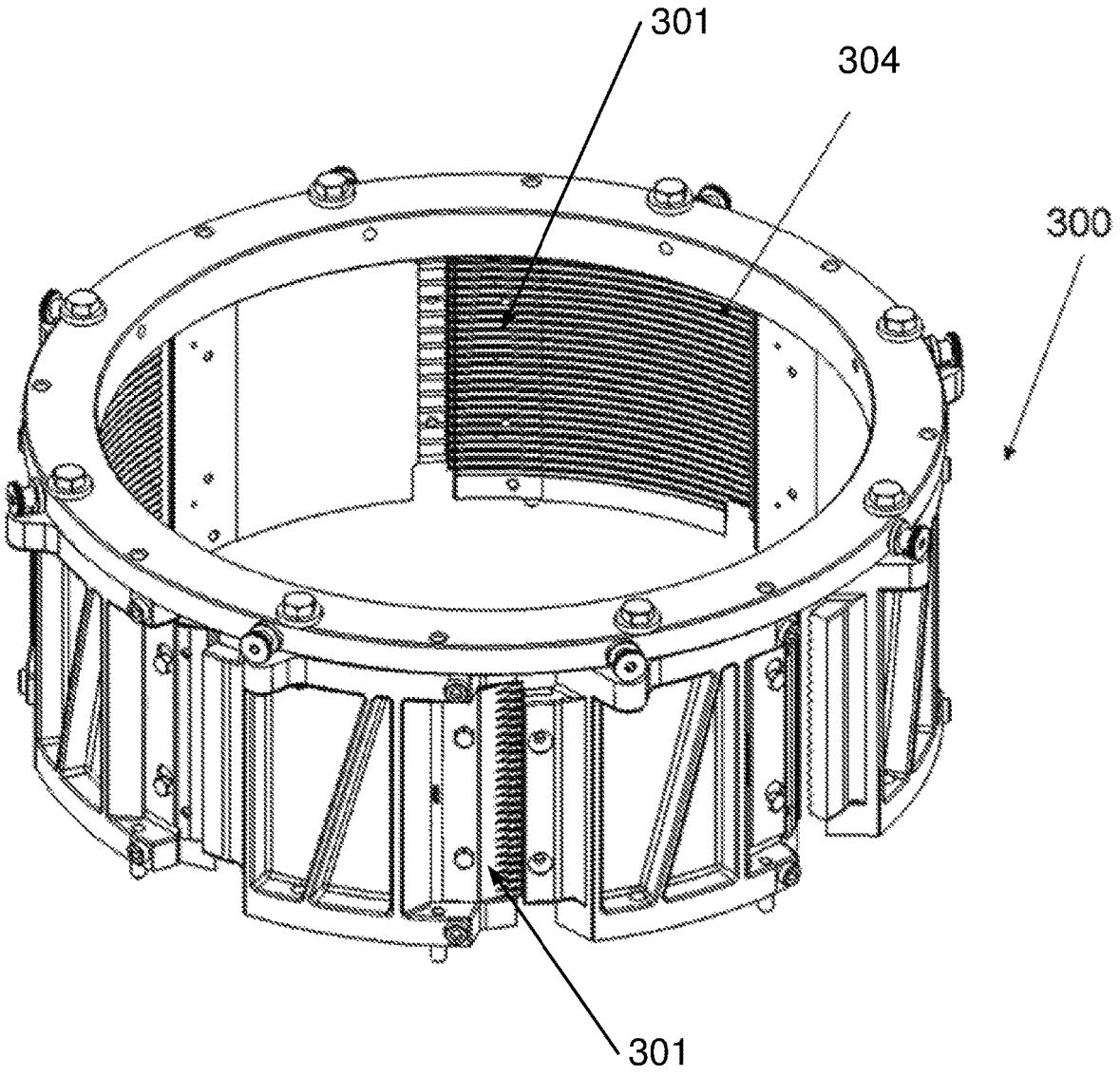
FIGS. 14-15 show a cutting head of a cutting apparatus using knife assemblies according to embodiments of this disclosure.
Figure 15:
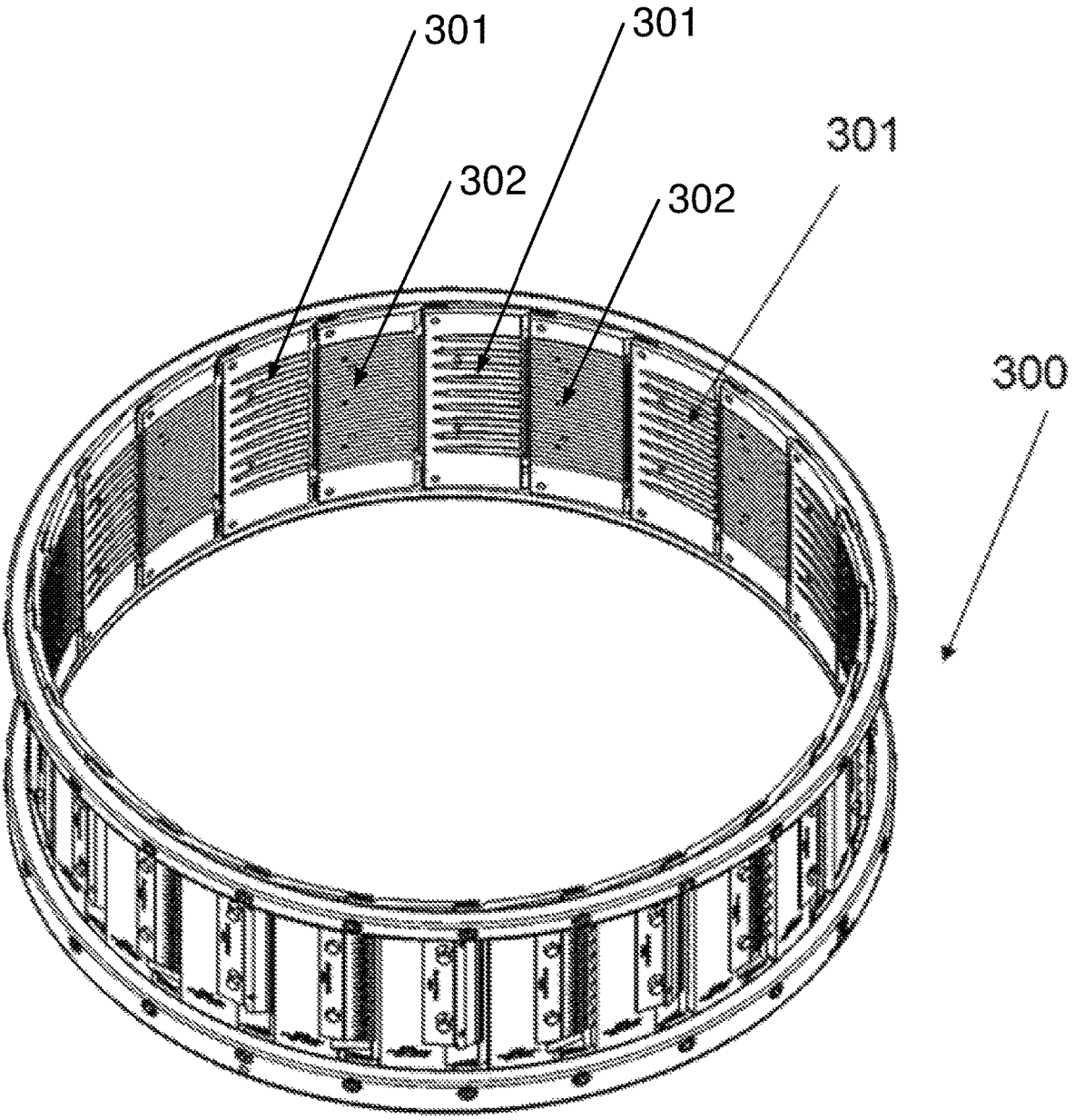

The knife assembly according to embodiments of this disclosure may be further fitted to a cutting head of a cutting apparatus, as shown in FIG. 14 and FIG. 15.

FIG. 14 and FIG. 15 show a cutting head 300 for a cutting apparatus (not shown). The cutting head 300 comprises a plurality of knife assemblies 301 which may be positioned along the circumference of the cutting head 300 for cutting products fed into the cutting head. The cutting head may be rotatably fitted to a base (not shown) of a cutting apparatus. The cutting apparatus may further comprise an impeller (not shown) adapted for rotating concentrically within the cutting head 300 to urge products fed into the cutting head 300 towards the circumference of the cutting head 300 by means of centrifugal force. The impeller may be driven at a first rotational speed by a first drive mechanism (not shown). In embodiments according to this disclosure, the cutting head may be further driven by a second drive mechanism (not shown) at a second rotational speed. In certain embodiments the rotation speed of the impeller may be different to the rotational speed of the cutting head 300.

In embodiments of this disclosure, the cutting head 300 may be fitted with a first knife assembly 301 having a knife blade of a first shape and a second knife assembly 302 having a knife blade of a second shape, which may be different to that of the first knife assembly. For example, the first knife assembly 301 may have a corrugated knife blade, while the second knife assembly 302 may be equipped with a flat shape knife blade. In a further example, the knife blade of the first assembly 301 may have a corrugated shape, which can be arranged to be different from the corrugated shape of the knife blade of the second knife assembly 302. This cutting head configuration may be used to produce a food product that has a different shape impression on each of its sides.

In the above mentioned embodiments of this disclosure an improved knife assembly for a knife blade may be provided such that during cutting of a food product the amount of food product caught in between any space between any of the following elements, in particular the knife blade, clamp and holder, is significantly reduced or eliminated, more in particular by providing completely complementary shapes for the clamp and the knife and/or the knife and the holder. In a further embodiment thereof the perfect fit may be achieved by use of grinding, in particular to program to use the grinding process to obtain the shapes discussed above and hence to program the shape until the fit is substantially complementary.

In a further embodiment thereof, in particular for use for knife blades with a symmetrical shape top and bottom, such as a wave shape, one and the same grinding disc can be used for shaping the clamp and the holder, and even parts of the cutting system or head or drum if it is desired that the grooves are also available on the insides of the cutting system or head or drum.

Figure 26:
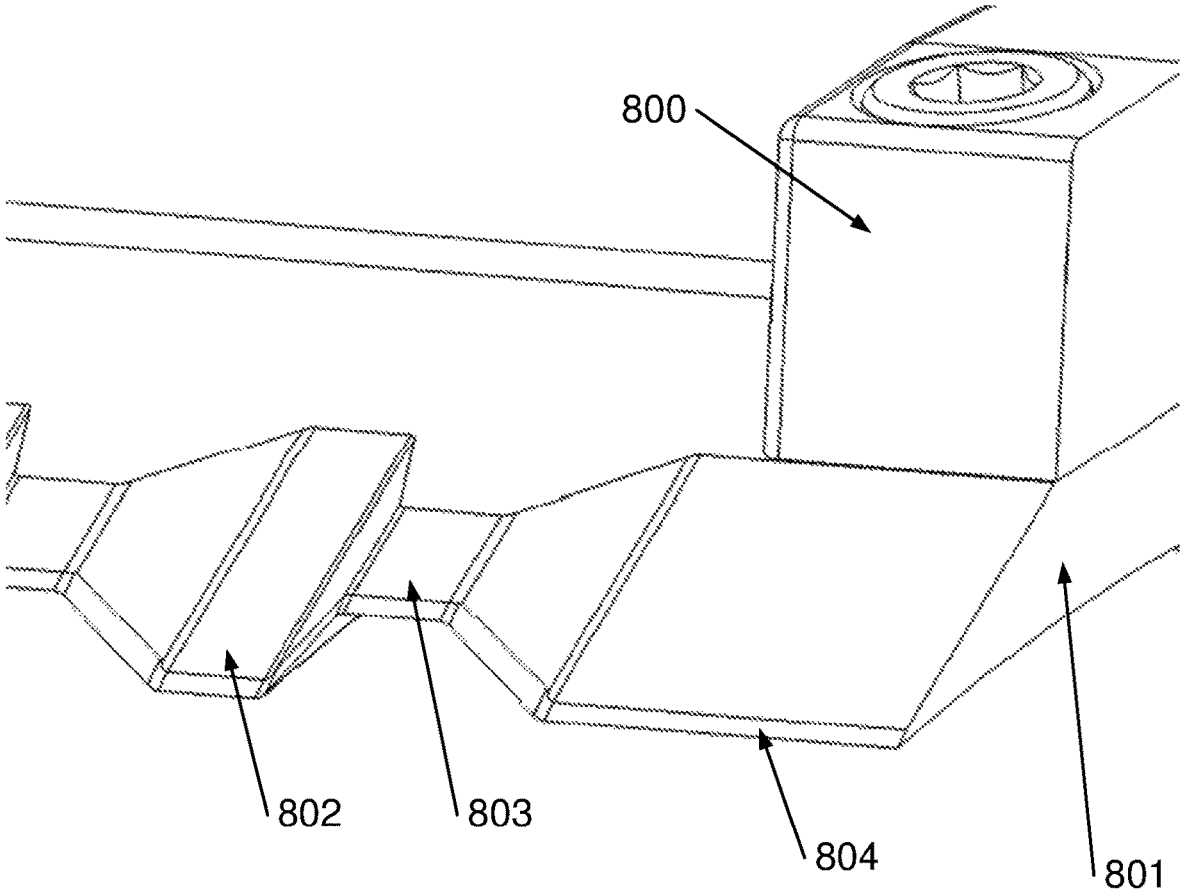
FIG. 26 shows an embodiment of another possibility for a knife assembly.

FIG. 26 shows an alternative possibility for a knife assembly for a cutting system (head or drum). In this possibility, the knife assembly comprises a cutting station 800 to which a knife 801 is attached. The knife 801 is in fact the knife holder 201 of the other embodiments described herein, but sharpened by means of a grinding operation so that it becomes in itself a knife. The grinding operation is done on the top side, after the trapezoidal wave shape has been obtained, resulting in the peaks being behind the front cutting edge. An advantage of this knife is that during cutting the valleys 802 of the knife contact the food product first, before the peaks 803 of the knife, so that the food product is cut more sequentially, which can improve the quality of the cut product and reduce wear on the knife. This principle can also be applied on other knife shapes, such as triangular wave shapes (like for example the knife holder 100 but sharpened so that it is a knife on its own), sinusoid wave shapes or other repetitive or non-repetitive shapes.

Figure 27:
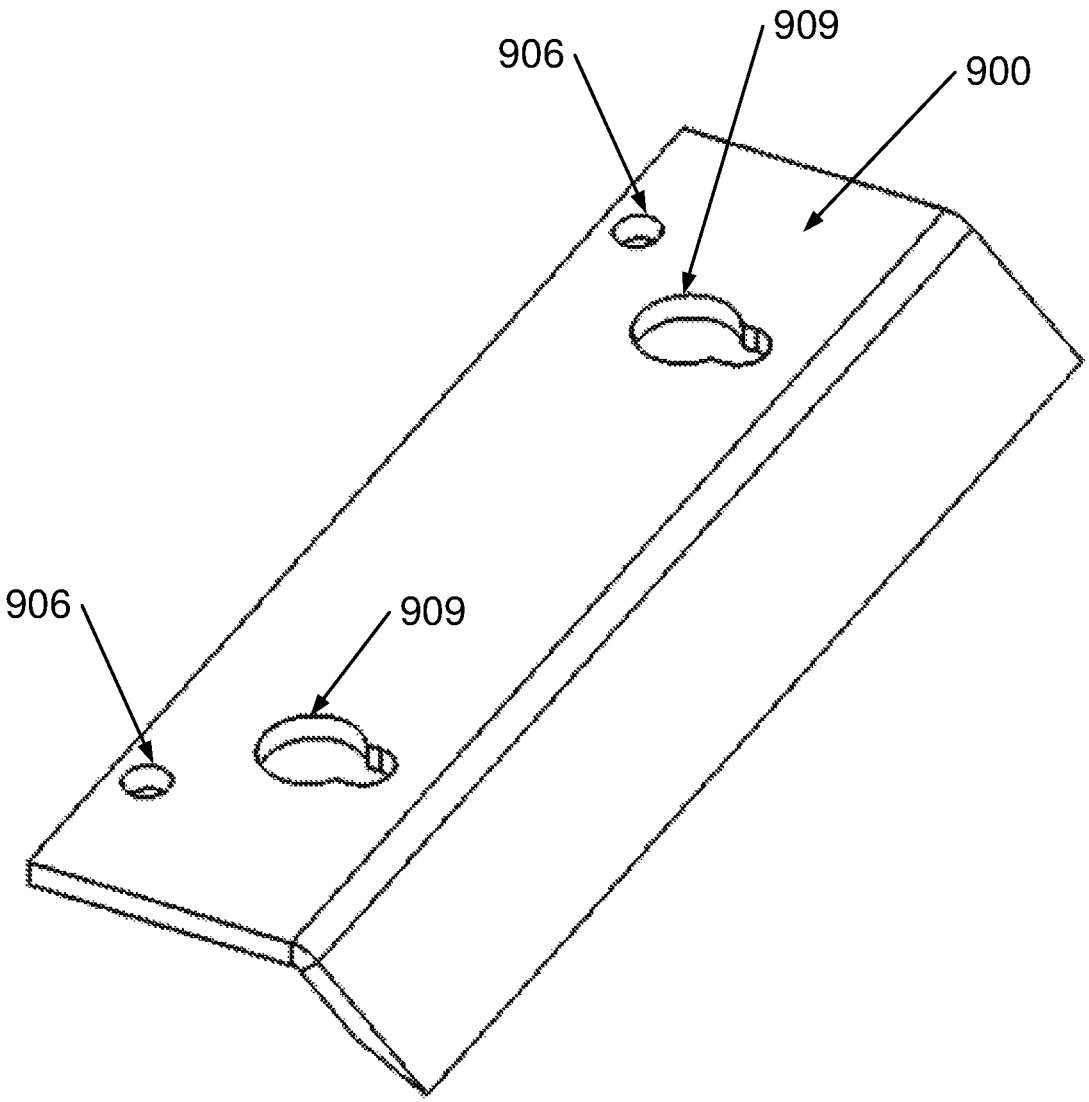
FIGS. 27-29 show a further embodiment of a knife assembly according to this disclosure.
Figure 28:
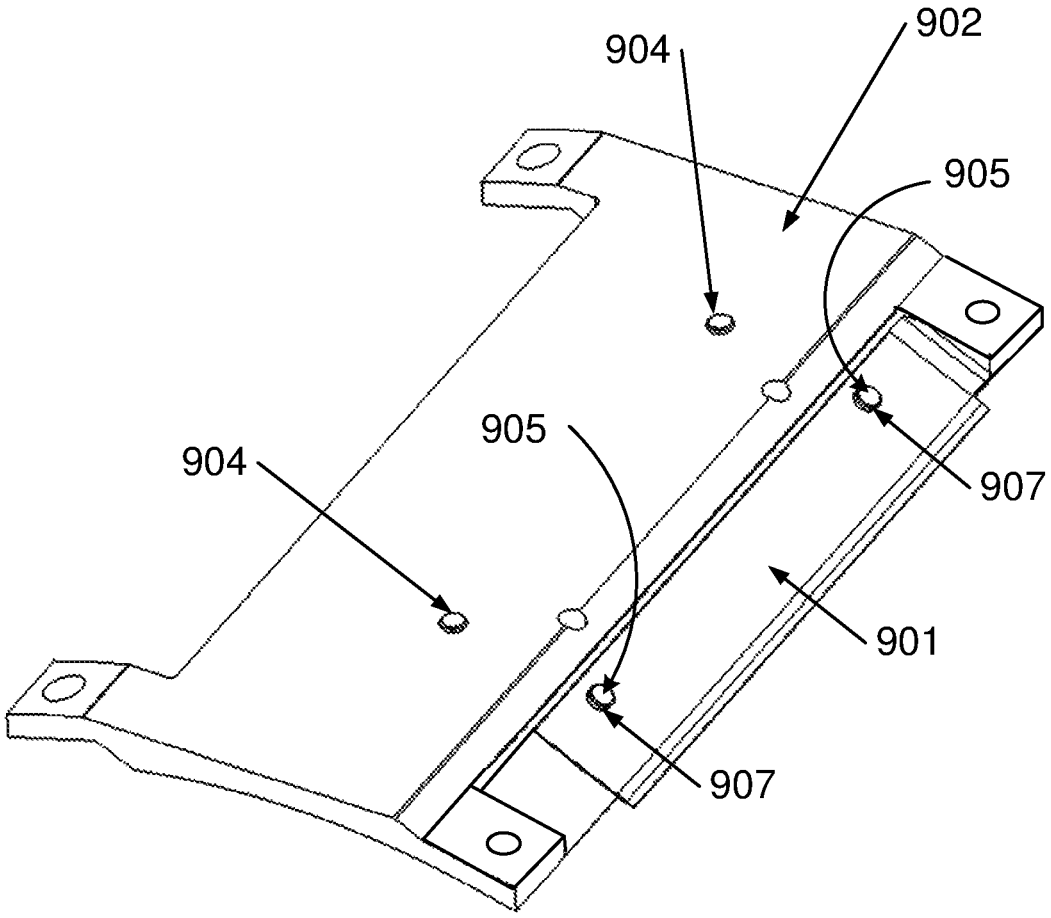
Figure 29:
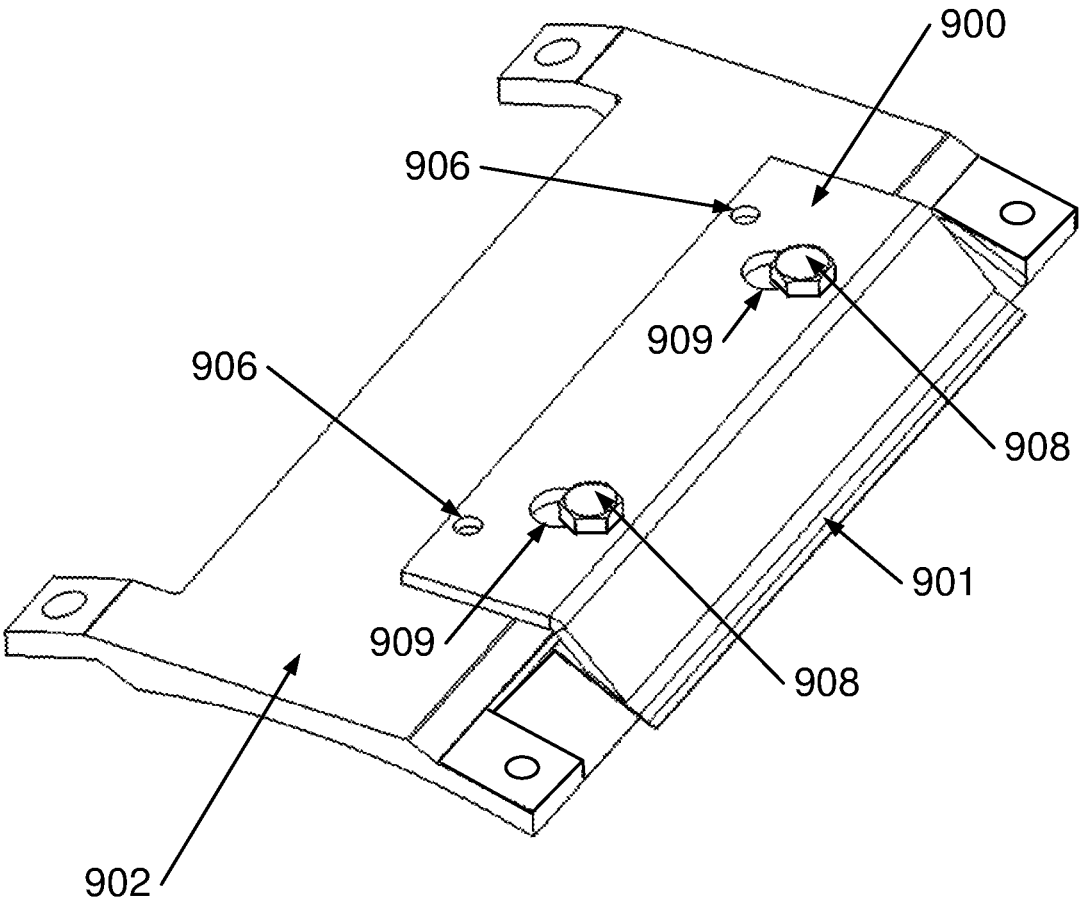

FIGS. 27-29 show a further embodiment of a knife assembly according to this disclosure with locating pins 904, 905 on the holder 902 and corresponding holes 906, 907 in the knife blade 901 and the clamp 900. These pins and holes function as positioning means for accurately positioning the knife blade 901 and the clamp 900 on the holder 902 before tightening the fastening mechanism, in this embodiment formed by the bolts 908 provided through slots 909 in the clamp 900 which are shaped for allowing the accurate positioning. These positioning means, which can also be realized by other means than the pins and holes shown in FIGS. 27-29, can help to achieve the tight fit of the clamp over the knife blade described above, i.e. to avoid penetration of product particles between the clamp and the knife blade. In FIGS. 27-29, the positioning means are shown on an embodiment with a flat knife blade, but it is clear that such positioning means may also be provided on embodiments, such as those described herein, with corrugated knife blades.

In further embodiments according to this disclosure, the knife assemblies may be provided for being fitted to cutting apparatuses of the type described in EP 1584429 A1, generally comprising a cutting wheel and a conveyor for feeding the food product towards the cutting wheel. The cutting wheel is rotatably mounted in a cutting space underneath a cap and rotates about a (usually) horizontal axis in this cutting space. The food product is conveyed towards the cutting space underneath the cap by the conveyor, which may be for example a double endless belt, a V-shaped conveyor, or a flat endless conveyor belt. The cutting wheel of such an apparatus comprises a hub and an outer rim interconnected by a plurality of cutting elements, which extend in radial direction of the cutting wheel. According to this disclosure, these cutting elements may be embodied as knife assemblies described herein, with the holder being provided for being mounted to the hub and the rim using fixing means known to the person skilled in the art.

In further embodiments according to this disclosure, the knife assemblies may be provided for being fitted to other types of cutting apparatuses known to the person skilled in the art.

In further embodiments according to this disclosure, the knife assemblies may be used in combination with knife blades (flat or corrugated) having so-called "julienne tabs". With such knife blades, the product is cut in two directions at once. It can for example be used to cut French fries from potatoes or to cut lettuce, or other products. The knife blades in this embodiment comprise a larger blade and a number of smaller blades (julienne tabs) extending at an angle thereto, for example substantially perpendicular thereto. The julienne tabs may be provided as bent-out sections of the knife blade, or as additional blades welded or otherwise permanently fixed onto the larger blades. The cutting edges of the larger blade and the julienne tabs may be coplanar or non-coplanar, with the cutting edges of the julienne tabs then being for example trailing with respect to the cutting edge of the larger blade (so the larger blade cuts first). The front cutting edges of the julienne tabs may be all at the same distance from the front cutting edge of the larger blade, or located at varying distances from the front cutting edge of the larger blade, for example in a staggered or alternating configuration. The clamps of the knife assemblies as disclosed herein may be provided with slots for accommodating and stabilizing the julienne tabs, so that during operation stresses can be relieved and the desired cut can be better maintained. In the case of a cutting head and/or cutting apparatus of the type like the one shown in FIGS. 14-15 and for example described in WO 2012139988 A1, the julienne tabs may be also or further stabilized by means of slots in the subsequent cutting station.

The invention claimed is:

1. A knife assembly comprising:

a knife blade of which a front edge is a cutting edge, the knife blade being a corrugated knife blade comprising a corrugated part having a continuous shape defining a periodic pattern of peaks and valleys over a certain distance;

a holder configured for supporting the knife blade;

a clamp arranged for clamping the knife blade onto the holder, the clamp having an inwardly corrugated shape complementary to the corrugated part of the knife blade; and a fastening mechanism cooperating with the holder and clamp for securing and clamping the knife blade to a clamped state in which it is clamped between the clamp and the holder with the cutting edge protruding at a front side of the knife assembly;

wherein the clamp comprises first clamping portions which are arranged along a first clamping line at a front side of the clamp and provided for in the clamped state contacting the knife blade at a complementary contact line on the knife blade, the complementary contact line being complementary to the clamping line and being located rearward from the front edge of the knife blade;

wherein the clamp comprises second clamping surfaces, formed by inwardly beveled parts of the clamp with a shape corresponding to complementary contact geometrical elements which are parts of the top side of the knife blade, the second clamping surfaces being positioned in a second clamping region which extends up to a predetermined distance rearward from said first clamping line and being provided for in the clamped state contacting the knife blade at the complementary contact geometrical elements, such that in the clamped state the clamp contacts the knife blade with the first clamping portions and the second clamping surfaces which together provide a contact over a width of the knife blade.

2. The knife assembly of claim 1, wherein the clamp and the holder have portions with corresponding shapes to obtain that in the clamped state the knife is contacted with the first clamping portions as well as the second clamping surfaces.

3. The knife assembly of claim 1, wherein the clamp is constructed such that in an unclamped state the inwardly beveled parts are offset from said parts of the top side of the knife blade and that in the clamped state the inwardly beveled parts contact said parts of the top side of the knife blade with a predetermined clamping force.

4. The knife assembly of claim 1, wherein in the clamped state said inwardly beveled parts exert a clamping force on the knife blade which is uniformly spread over the corresponding contact geometrical elements of the knife blade.

5. The knife assembly of claim 1, wherein the clamp comprises a plurality of fingers, said fingers having tips which form said first clamping portions arranged along said first clamping line and rearward parts which are said inwardly beveled parts that form said second clamping surfaces arranged in said second clamping region.

6. The knife assembly of claim 5, wherein at least some of said inwardly beveled parts are flat surfaces, arranged to contact surface areas of the valleys of the knife blade in the clamped state, and wherein the inwardly beveled parts have a length, in a direction perpendicular to the cutting edge, of at least 1 mm and at most 20 mm.

7. The knife assembly of claim 6, wherein the inwardly beveled parts have a length of at most 15 mm.

8. The knife assembly of claim 6, wherein the inwardly beveled parts have a length of at most 10 mm.

9. The knife assembly of claim 5, wherein the rearward parts comprise side surfaces of said fingers arranged for contacting slanted surface portions of the knife blade in the clamped state.

10. The knife assembly of claim 1, wherein the clamp is shaped such that in the clamped state the clamp fits over the knife blade over its entire width.

11. The knife assembly of claim 1, wherein the clamp comprises stop parts arranged to engage rear edges of the knife blade.

12. The knife assembly of claim 1, wherein stopping elements are provided, each of the stopping elements comprising an upwards widening portion arranged for engaging a rear edge of the knife blade and pushing said read edge downwards on the holder.

13. A cutting system with at least one first knife assembly according to claim 1 positioned along the circumference of the cutting system for cutting products fed into the cutting system.

14. The cutting system according to claim 13, further comprising at least one second knife assembly positioned along the circumference of the cutting system for cutting products fed into the cutting system, the cutting system comprising an impeller for moving products to be cut towards the circumference of the cutting system by centrifugal force, the at least one second knife assembly comprising a knife blade having a substantially flat shape.

15. The cutting system according to claim 14, wherein the first and second knife assemblies are alternately positioned along the circumference of the cutting system.

16. The cutting system according to claim 13, further comprising at least one second knife assembly positioned along the circumference of the cutting system for cutting products fed into the cutting system, the cutting system comprising an impeller for moving products to be cut towards the circumference of the cutting system by centrifugal force, the at least one second knife assembly comprising a knife blade having a second corrugated shape different from that of the at least one first knife assembly.

17. The cutting system according to claim 16, wherein the first and second knife assemblies are alternately positioned along the circumference of the cutting system.

18. The knife assembly of claim 1, wherein the inwardly beveled parts extend forwards up to the first clamping line.

19. The knife assembly of claim 1, wherein the second clamping region is adjacent to the first clamping line.

* * * * *